US008254803B2

(12) United States Patent
Fujiya et al.

(10) Patent No.: US 8,254,803 B2
(45) Date of Patent: Aug. 28, 2012

(54) IMAGE FORMING APPARATUS INCLUDING A COOLING DEVICE

(75) Inventors: Hiromitsu Fujiya, Kawasaki (JP); Kenichi Takehara, Sagamihara (JP); Yasuaki Iijima, Yokohama (JP); Takayuki Nishimura, Tokyo (JP); Satoshi Okano, Yokohama (JP); Tomoyasu Hirasawa, Yokohama (JP); Shingo Suzuki, Yokohama (JP); Masanori Saitoh, Komae (JP)

(73) Assignee: Ricoh Company, Limited, Tokyo (JP)

( * ) Notice: Subject to any disclaimer, the term of this patent is extended or adjusted under 35 U.S.C. 154(b) by 366 days.

(21) Appl. No.: 12/617,138

(22) Filed: Nov. 12, 2009

(65) Prior Publication Data

US 2010/0183323 A1 Jul. 22, 2010

(30) Foreign Application Priority Data

Nov. 13, 2008 (JP) ..... 2008-291166
Jun. 8, 2009 (JP) ..... 2009-137426
Nov. 11, 2009 (JP) ..... 2009-257855

(51) Int. Cl.
*G03G 21/20* (2006.01)

(52) U.S. Cl. ..... 399/94; 399/119

(58) Field of Classification Search ..... 399/91, 399/94, 111, 119
See application file for complete search history.

(56) References Cited

U.S. PATENT DOCUMENTS

| | | | | |
|---|---|---|---|---|
| 4,545,671 | A * | 10/1985 | Anderson | 399/341 |
| 5,166,728 | A * | 11/1992 | Nagaoka et al. | 399/91 |
| 6,785,490 | B2 * | 8/2004 | Tsukamoto et al. | 399/94 |
| 6,922,538 | B2 * | 7/2005 | Kimura | 399/94 |
| 2010/0008694 | A1 * | 1/2010 | Okano et al. | 399/94 |
| 2010/0008695 | A1 * | 1/2010 | Okano et al. | 399/94 |
| 2011/0164896 | A1 * | 7/2011 | Hirasawa et al. | 399/94 |
| 2011/0188880 | A1 * | 8/2011 | Suzuki et al. | 399/94 |

FOREIGN PATENT DOCUMENTS

| | | | |
|---|---|---|---|
| JP | 2003114577 | A * | 4/2003 |
| JP | 2005-164927 | | 6/2005 |
| JP | 2005-266249 | | 9/2005 |
| JP | 2006-3628 | | 1/2006 |
| JP | 2006003628 | A * | 1/2006 |
| JP | 2007047540 | A * | 2/2007 |
| JP | 2008277684 | A * | 11/2008 |

* cited by examiner

*Primary Examiner* — Robert Beatty
(74) *Attorney, Agent, or Firm* — Oblon, Spivak, McClelland, Maier & Neustadt, L.L.P.

(57) ABSTRACT

An image forming apparatus including a target part to be cooled detachably attachable to the image forming apparatus, a cooling device including a heat receiving part provided to contact the target part to be cooled to receive heat from the target part to be cooled with a cooling medium provided within the heat receiving part, and a contact/separation mechanism to cause the heat receiving part to contact and separate from the target part to be cooled. The contact/separation mechanism includes a pressing unit to press the heat receiving part against the target part to be cooled. A reaction of a pressing force of the heat receiving part applied to the pressing unit when the heat receiving part is pressed against the target part to be cooled is directed onto a predetermined portion of the target part to be cooled.

20 Claims, 23 Drawing Sheets

IMAGE FORMING APPARATUS INCLUDING A COOLING DEVICE

CROSS-REFERENCE TO RELATED APPLICATIONS

The present patent application is based on and claims priority pursuant to 35 U.S.C. §119 from Japanese Patent Application Nos. 2008-291166, filed on Nov. 13, 2008 in the Japan Patent Office, 2009-137426, filed on Jun. 8, 2009 in the Japan Patent Office, and 2009-257855, filed on Nov. 11, 2009 in the Japan Patent Office, the entire contents of each of which are incorporated herein by reference.

BACKGROUND OF THE INVENTION

1. Field of the Invention

Exemplary aspects of the present invention generally relate to an image forming apparatus such as a copier, a facsimile machine, or a printer.

2. Description of the Background

Related-art image forming apparatuses typically form a toner image on a recording medium (e.g., a sheet) according to image data using an electrophotographic method. In such a method, for example, a charger charges a surface of a latent image bearing member (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet; and a fixing device applies heat and pressure to the sheet bearing the toner image to fix the toner image onto the sheet. The sheet bearing the fixed toner image is then discharged from the image forming apparatus.

A temperature within the image forming apparatuses is usually increased due to heat generated by the irradiating device, the developing device, the fixing device, and so forth.

For example, in the developing device, when a developer agitator is driven to agitate and convey developer within the developing device, the temperature within the image forming apparatus is increased due to frictional heat generated by friction between the developer agitator and the developer, and friction within the developer. Further, frictional heat generated by friction between the developer and a developer restriction member (often a doctor blade or the like) that regulates a thickness of the developer borne by a developer bearing member before the developer reaches a developing position inside the image forming apparatus, and friction within the developer occurring with regulation by the developer restriction member also causes an increase in a temperature within the image forming apparatuses.

The increase in temperature of the image forming apparatuses causes a decrease in an amount of charge given the toner in order to form images, thereby increasing an amount of toner attached to the recording medium. Consequently, a predetermined image density cannot be attained. Further, the temperature increase can melt the toner, causing the melted toner to adhere to the developer restriction member, the developer bearing member, the photoconductor, and so forth, possibly causing irregular images having undesired lines as a result. In particular, when recently-used toner having a lower melting temperature is used in an effort to reduce fixing energy, irregular images due to toner adhesion are more likely to occur.

To solve the above-described problems, a technique in which air introduced by an air-cooling fan is conveyed to the developing device and/or a surrounding area through a duct to generate airflow for cooling the developing device has been proposed to prevent an excessive increase in temperature of the developing device. However, recent demands for downsizing of the image forming apparatuses has caused components to be densely packed within the image forming apparatuses, and a space provided around the developing device has been limited. Consequently, it is difficult to provide the duct to convey the airflow to the portion around the developing device, and that makes it difficult to cool the developing device using the above-described technique.

In addition, the following problems arise in the transfer device. Specifically, an intermediate transfer belt included in the transfer device is cleaned by a cleaning blade included in a belt cleaning unit to remove residual toner and so forth from the intermediate transfer belt after transfer. The toner thus removed is collected by a waste toner conveyance unit, and then is accumulated in a waste toner container with other waste toner within the image forming apparatus.

Because the belt cleaning unit is usually positioned near the fixing device and itself generates heat, the temperature of the belt cleaning unit will exceed the melting point of the toner if left as is. In order to prevent an excessive increase in temperature of the transfer device partially contacting the belt cleaning unit, a technique in which air introduced by an air-cooling fan is conveyed to a portion around the transfer device through a duct to generate airflow for cooling the transfer device has been proposed. However, as described above, recent demands for downsizing of the image forming apparatuses has caused components to be ever more densely packed within the image forming apparatuses, and a space provided around the transfer device has been limited. Consequently, it is difficult to provide the duct to convey the airflow to the portion around the transfer device, and that makes it difficult to cool the transfer device using the above-described technique. Further, if the airflow is generated around the transfer device to cool the transfer device, toner scattering may occur within and outside the image forming apparatus.

Published Unexamined Japanese Patent Application No. 2005-164927 (hereinafter referred to as JP-2005-164927-A) discloses an image forming apparatus employing a liquid cooling method in which a liquid is circulated to cool a developing device that generates heat. A liquid cooling device provided in the image forming apparatus includes a heat receiving part contacting a wall of the developing device such that a cooling liquid within the heat receiving part receives heat from the developing device, a radiator serving as heat releasing means to release heat from the cooling liquid, a circulation pipe to circulate the cooling liquid between the heat receiving part and the radiator, and a conveyance pump to convey the cooling liquid within the circulation pipe to the heat receiving part. Because it provides better cooling performance than the air cooling device does, the liquid cooling device can more efficiently cool the developing device compared to the air cooling device. Further, the circulation pipe to circulate the cooling liquid is smaller than the duct described above, so that even those image forming apparatuses having a smaller space around the developing device can include the circulation pipe around the developing device. Accordingly, the developing device provided within the densely-packed image forming apparatus can be efficiently cooled.

In general, the developing device is detachably attachable to the image forming apparatus either directly by itself or indirectly through integration with the photoconductor as a process cartridge. Because the size and stability of a developing gap formed between the photoconductor and the developer bearing member in the developing device considerably influence image quality, the image forming apparatus generally includes positioning means for accurately installing the developing device at a position relative to the photoconductor.

In the image forming apparatus disclosed in JP-2005-164927-A, a contact/separation mechanism is provided such that the heat receiving part is separated from the developing device when the developing device is detached from the image forming apparatus, and the heat receiving part is pressed against the developing device using biasing means to contact the developing device when the developing device is attached to the image forming apparatus, thus facilitating attachment/detachment of the developing device to and from the image forming apparatus.

However, because the heat receiving part is pressed against the developing device using the biasing means when the developing device is attached to the image forming apparatus, a force applied to the developing device from the heat receiving part acts on the positioning means and so forth. Consequently, the positioning means and so forth may be inadvertently deformed, causing a change in the developing gap.

Further, if the liquid cooling method disclosed in JP-2005-164927-A is used to cool the belt cleaning unit, the intermediate transfer belt is not properly cleaned by the cleaning blade when a distance between the intermediate transfer belt and a cleaning blade is inadvertently changed.

For example, when the distance between the cleaning blade and the intermediate transfer belt is larger than a predetermined value, toner remaining on the intermediate transfer belt cannot be reliably removed by the cleaning blade, and the next sequence of transfer operations is performed with the intermediate transfer belt having residual toner thereon. Consequently, image blur and operation shutdown of the transfer device due to clogging of toner may occur.

By contrast, when the distance between the cleaning blade and the intermediate transfer belt is too small, the cleaning blade may curl up, possibly damaging the cleaning blade or the intermediate transfer belt as a consequence.

SUMMARY

In view of the foregoing, illustrative embodiments of the present invention provide an image forming apparatus to solve problems such as a change in a position of a device that generates heat when a heat receiving part is pressed against such a device.

In one illustrative embodiment, an image forming apparatus includes a target part to be cooled detachably attachable to the image forming apparatus; a cooling device including a heat receiving part provided to contact the target part to be cooled to receive heat from the target part to be cooled with a cooling medium provided within the heat receiving part; and a contact/separation mechanism to cause the heat receiving part to contact and separate from the target part to be cooled. The contact/separation mechanism includes a pressing unit to press the heat receiving part against the target part to be cooled. A reaction of a pressing force of the heat receiving part applied to the pressing unit when the heat receiving part is pressed against the target part to be cooled is directed onto a predetermined portion of the target part to be cooled.

Another illustrative embodiment provides an image forming apparatus including a latent image bearing member; a developing device detachably attachable to the image forming apparatus, the developing device including a developer bearing member to convey a developer to a position opposite the latent image bearing member; a positioning member to determine a position of the developing device relative to the latent image bearing member; a cooling device including a heat receiving part provided to contact a surface of the developing device to receive heat from the target part to be cooled with a cooling medium provided within the heat receiving part; and a contact/separation mechanism to cause the heat receiving part to contact and separate from the developing device. The contact/separation mechanism includes a pressing unit to press the heat receiving part against the surface of the developing device. A reaction of a pressing force of the heat receiving part applied to the pressing unit when the heat receiving part is pressed against the surface of the developing device is directed onto a predetermined portion of the developing device.

Additional features and advantages of the present invention will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
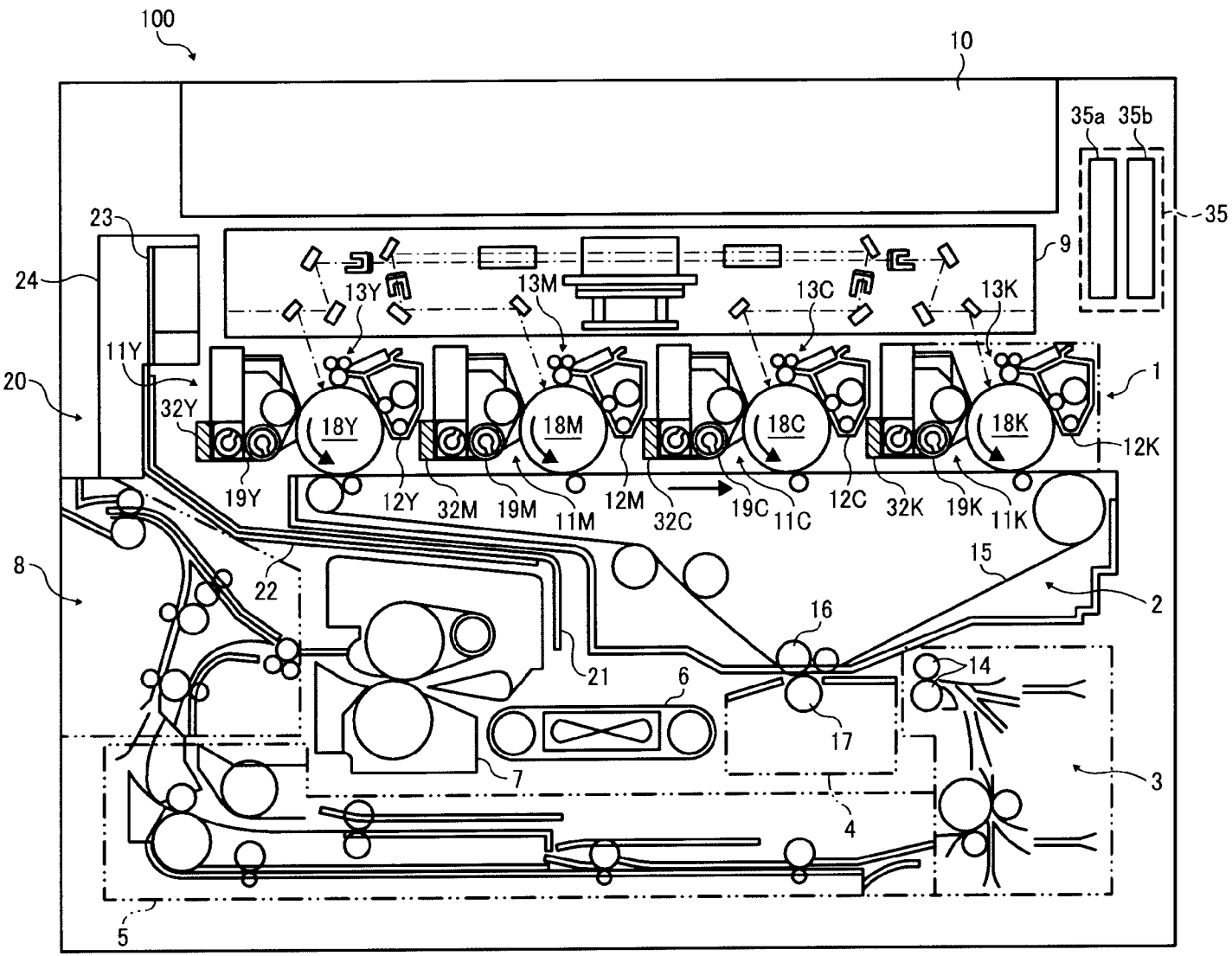
FIG. 1 is a schematic view illustrating an example of a configuration of an image forming apparatus according to illustrative embodiments.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

A description is now given of a configuration and operations of an image forming apparatus according to illustrative embodiments.

FIG. 1 is a schematic view illustrating an example of a configuration of an image forming apparatus 100 according to illustrative embodiments. Referring to FIG. 1, the image forming apparatus 100 includes an image forming part 1 in which four image forming units 11Y, 11M, 11C, and 11K are arranged in parallel to one another. The image forming units 11Y, 11M, 11C, and 11K respectively include drum-type photoconductors 18Y, 18M, 18C, and 18K, each serving as a latent image bearing member; drum cleaning units 12Y, 12M, 12C, and 12K; chargers 13Y, 13M, 13C, and 13K; developing devices 19Y, 19M, 19C, and 19K, each employing a two-component developing method; and so forth. Each of the image forming units 11Y, 11M, 11C, and 11K is detachably attachable to the image forming apparatus 100 so that consumable parts can be replaced with new ones at a time.

An irradiating device 9 serving as latent image forming means is provided above the image forming part 1. The image forming apparatus 100 further includes a reading device 10 at an upper portion thereof. The reading device 10 scans a document placed on a contact glass to read the document. A transfer device 2 including an intermediate transfer belt 15 serving as an intermediate transfer body is provided below the image forming part 1. The intermediate transfer belt 15 is wound around multiple support rollers, and is rotated in a clockwise direction in FIG. 1. A secondary transfer device 4 including a secondary transfer roller 17 is provided below the transfer device 2. The secondary transfer roller 17 contacts an outer surface of the intermediate transfer belt 15 at a portion where the intermediate transfer belt 15 is wound around a transfer opposing roller 16, so that a secondary transfer nip is formed between the intermediate transfer belt 15 and the secondary transfer device 4. A secondary transfer bias is applied to the secondary transfer roller 17 from a power source, not shown, and the transfer opposing roller 16 is electrically grounded. Accordingly, a secondary transfer magnetic field is formed within the secondary transfer nip. The image forming apparatus 100 further includes a fixing device 7 on the left of the secondary transfer device 4 in FIG. 1. The fixing device 7 includes a heat roller having a heat generator therein to fix a transferred toner image to a sheet. A conveyance belt 6 is provided between the secondary transfer device 4 and the fixing device 7 to convey the sheet having the transferred toner image thereon to the fixing device 7. A paper feeder 3 is provided at a lower portion of the image forming apparatus 100 to feed a sheet fed one by one from a sheet storage, not shown, to the secondary transfer device 4. The image forming apparatus 100 further includes a discharge device 8 to either discharge the sheet conveyed from the fixing device 7 from the image forming apparatus 100 or convey the sheet to a duplex device 5.

When a document is copied using the image forming apparatus 100, first, the document is read by the reading device 10. At the same time, the intermediate transfer belt 15 is rotated in the clockwise direction in FIG. 1, and the irradiating device 9 irradiates surfaces of the photoconductors 18Y, 18M, 18C, and 18K each charged by the chargers 13Y, 13M, 13C, and 13K using image data of specific colors of yellow, magenta, cyan, and black based on the document read by the reading device 10 to form latent images of the respective colors. Subsequently, the latent images respectively formed on the surfaces of the photoconductors 18Y, 18M, 18C, and 18K are developed by the developing devices 19Y, 19M, 19C, and 19K to form toner images of each color. The toner images thus formed on the surfaces of the photoconductors 18Y, 18M, 18C, and 18K, respectively, are sequentially transferred onto the intermediate transfer belt 15 in a superimposed manner to form a full-color toner image on the intermediate transfer belt 15. Thereafter, the surfaces of the photoconductors 18Y, 18M, 18C, and 18K after transfer of the toner images are cleaned by the drum cleaning units 12Y, 12M, 12C, and 12K to remove residual toner therefrom and be ready for the next sequence of image forming operations.

While the full-color toner image is formed as described above, sheets are fed one by one from the sheet storage, not shown. The sheet thus fed is conveyed to a pair of registration rollers 14 and is stopped at the pair of registration rollers 14. The pair of registration rollers 14 is rotated in synchronization with the full-color toner image formed on the intermediate transfer belt 15 to convey the sheet between the intermediate transfer belt 15 and the secondary transfer device 4. Accordingly, the full-color toner image is transferred onto the sheet by the secondary transfer device 4. The sheet having the full-color toner image thereon is conveyed to the fixing device 7 by the conveyance belt 6. In the fixing device 7, heat and pressure are applied to the sheet to fix the full-color toner image to the sheet. The sheet having a fixed full-color image thereon is then conveyed to the discharge device 8. The discharge device 8 guides the sheet to either a discharge tray, not shown, provided on an exterior of the image forming apparatus 100, or the duplex device 5 using a switching pick. The duplex device 5 reverses the sheet so that the sheet is guided to the secondary transfer nip again to form an image on a back side of the sheet. Thereafter, the sheet having the image on both sides thereof is discharged to the discharge tray by the discharge device 8. It is to be noted that, the intermediate transfer belt 15 after transfer of the full-color toner image onto the sheet is cleaned by a belt cleaning unit 1000, not shown in FIG. 1, to remove residual toner therefrom and be ready for the next sequence of image forming operations.

Figure 2:
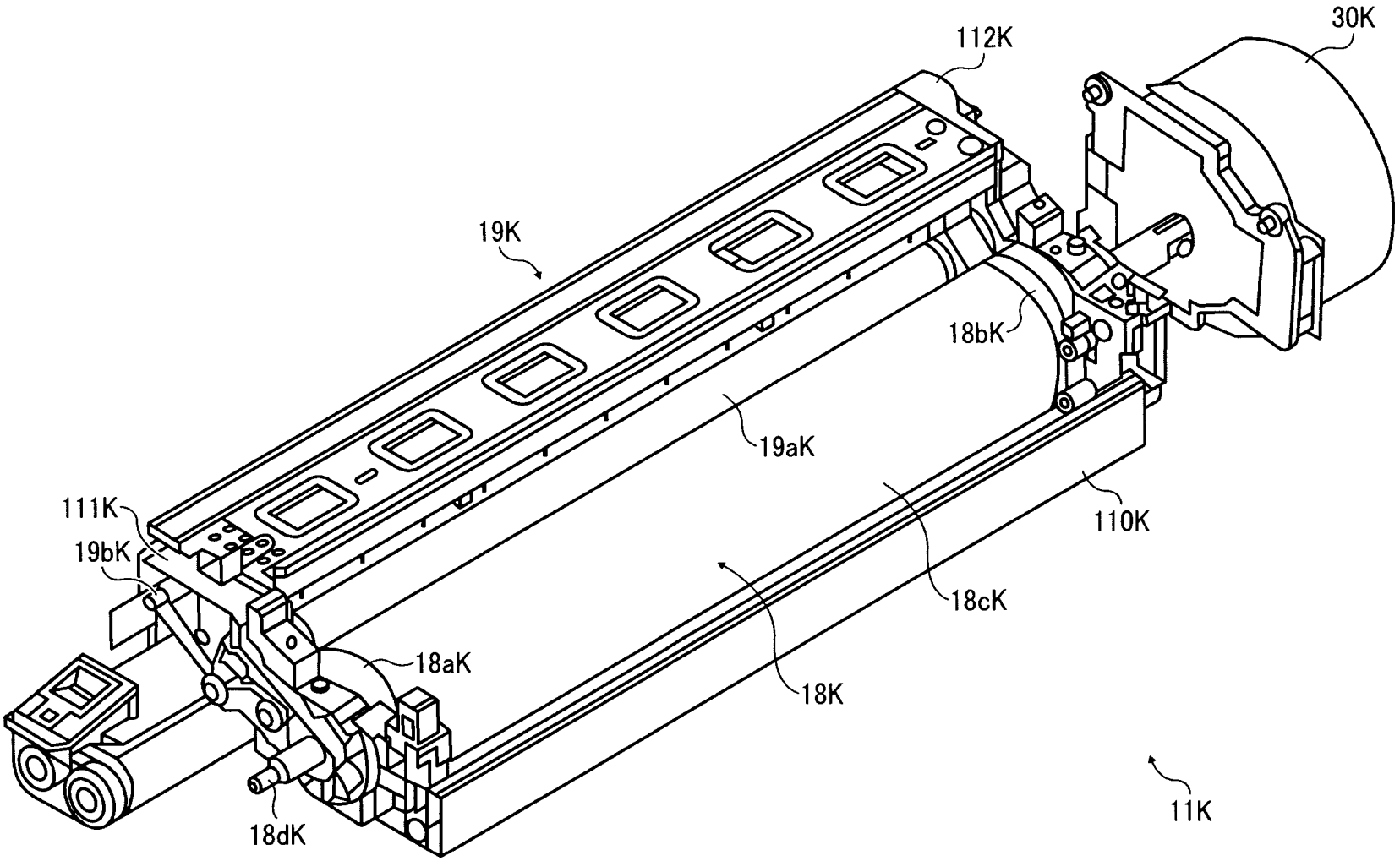
FIG. 2 is a perspective view illustrating an image forming unit for a color of black when viewed from the front.
Figure 3:
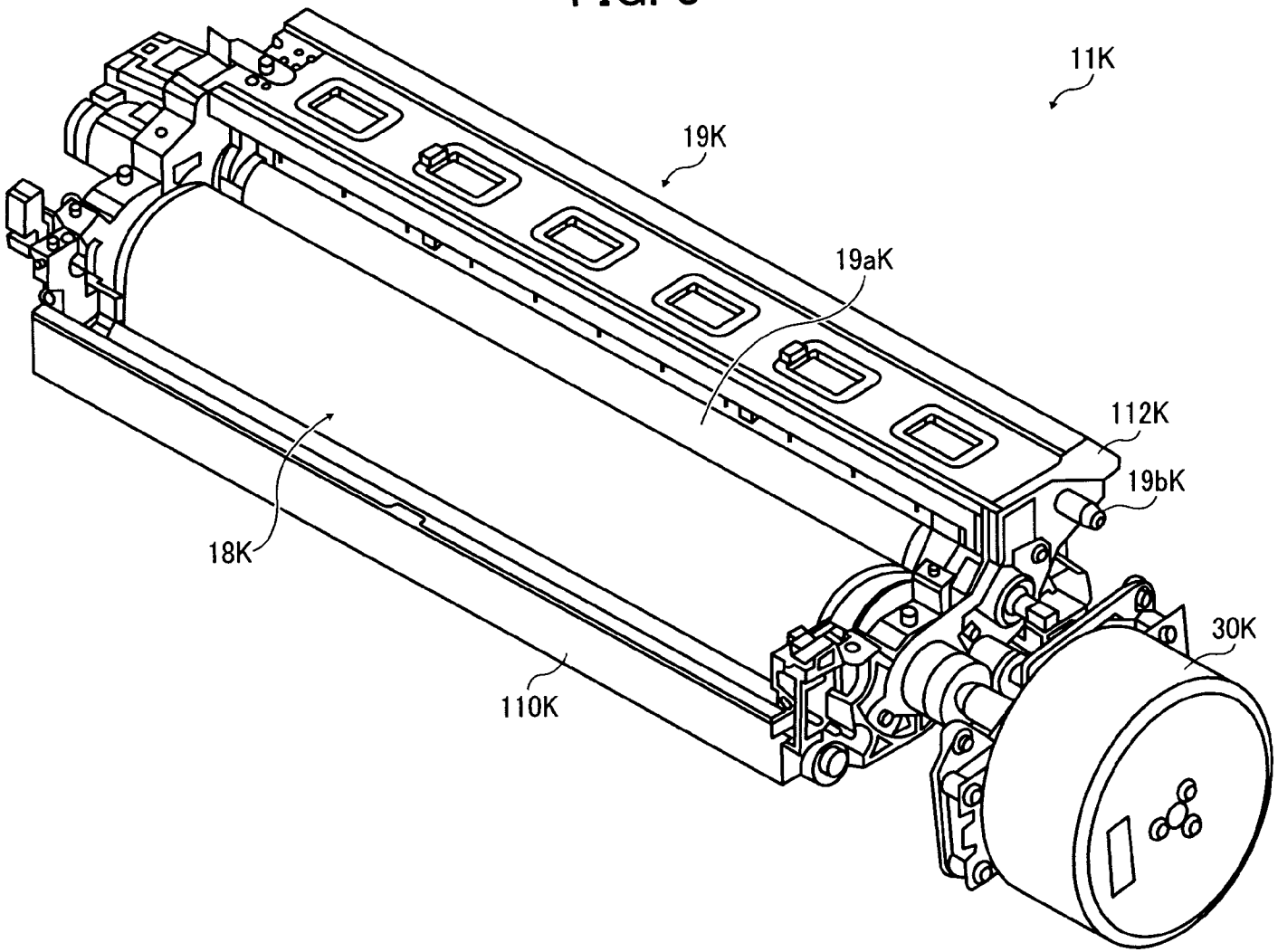
FIG. 3 is a perspective view illustrating the image forming unit illustrated in FIG. 2 when viewed from the back.

FIG. 2 is a perspective view illustrating the image forming unit 11K when viewed from the front. FIG. 3 is a perspective view illustrating the image forming unit 11K when viewed from the back. In FIGS. 2 and 3, for simplification, only the photoconductor 18K and the developing device 19K included in the image forming unit 11K are illustrated.

The photoconductor 18K includes a photoconductive duct 18*c*K coated with a photoconductive layer, a front flange 18*a*K, and a back flange 18*b*K. The front flange 18*a*K and the back flange 18*b*K are rotatably supported by a frame 110K of the image forming unit 11K.

After being temporarily determined on the frame 110K, a position of the developing device 19K is determined on the frame 110K by a front positioning plate 111K and a back positioning plate 112K each serving as positioning means.

The front and back positioning plates 111K and 112K rotatably support a drum shaft 18*d*K serving as a support shaft of the photoconductor 18K and a developing roller shaft, not shown, of a developing roller 19*a*K serving as a developer bearing member of the developing device 19K, so that a predetermined developing gap is kept between the photoconductor 18K and the developing roller 19*a*K. Specifically, the drum shaft 18*d*K of the photoconductor 18K is rotatably fitted in the front and back positioning plates 111K and 112K via bearings. Further, the developing roller shaft of the developing roller 19*a*K is rotatably fitted in the front and back positioning plates 111K and 112K via bearings.

A sub-reference long hole, not shown, is formed on the back positioning plate 112K, and a sub-reference pin 19*b*K fixed to the developing device 19K is fitted in the sub-reference long hole. Similarly, a sub-reference long hole, not shown, is formed on the front positioning plate 111K, and a sub-reference pin 19*b*K fixed to the developing device 19K is fitted in the sub-reference long hole. Accordingly, the developing device 19K is prevented from rotating around a central axis of the developing roller 19*a*K.

An opening to attach or detach the image forming unit 11K to or from the image forming apparatus 100 is provided at a lateral surface of the image forming apparatus 100. When the image forming unit 11K is attached to the image forming apparatus 100, the drum shaft 18*d*K extending from a photoconductor motor 30K passes through the photoconductor 18K and is fitted in the bearings of each of the front and back positioning plates 111K and 112K. Accordingly, a position of the photoconductor 18K is appropriately determined, and a distance between a central axis of the photoconductor 18K and the central axis of the developing roller 19*a*K is accurately restricted. As a result, a gap between the photoconductor 18K and the developing roller 19*a*K, that is, a developing gap, is reliably kept, and a high-quality toner image is formed on the surface of the photoconductor 18K. From a viewpoint of cost reduction and weight reduction, it is preferable that the front and back positioning plates 111K and 112K be formed of a resin material. Alternatively, the front and back positioning plates 111K and 112K are formed of metal.

Figure 4:
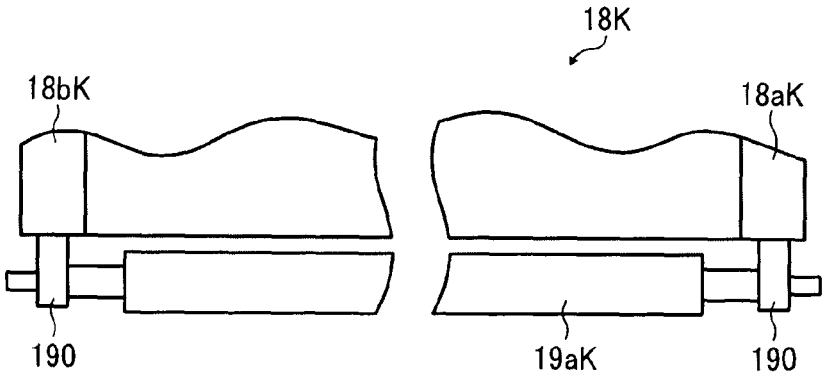
FIG. 4 is a schematic view illustrating a configuration in which a metal roller is provided at both ends of a developing roller.

In place of the above-described configuration, alternatively, a metal roller 190 may be provided at both ends of the developing roller 19*a*K as illustrated in FIG. 4. The metal rollers 190 are caused to contact the front and back flanges 18*a*K and 18*b*K, respectively, to provide a predetermined developing gap between the developing roller 19*a*K and the photoconductor 18K. Accordingly, a position of the photoconductor 18K is appropriately determined.

From a viewpoint of downsizing of the image forming apparatus 100, components are densely packed within the image forming apparatus 100. Further, as illustrated in FIG. 1, the fixing device 7 is provided immediately below the transfer device 2, and the intermediate transfer belt 15 is bent to cover upper and right surfaces of the fixing device 7. Such a configuration enables to reduce height and width of the image forming apparatus 100.

However, when the fixing device 7 is positioned close to the intermediate transfer belt 15, the intermediate transfer belt 15 may be deformed due to heat generated by the fixing device 7 serving as a heat generator. Consequently, irregular images including color shift and so forth may occur.

This problem is more prominent in high-speed image forming apparatuses within which a larger amount of heat is generated. Further, when images are formed on both sides of the sheet, the sheet heated by the fixing device 7 passes through the duplex device 5, and then the sheet contacts the intermediate transfer belt 15 again at the secondary transfer nip. Consequently, a temperature of the intermediate transfer belt 15 is further increased due to heat transmitted from the sheet. Heat is further transmitted from the intermediate transfer belt 15 to the photoconductors 18Y, 18M, 18C, and 18K each contacting the intermediate transfer belt 15, and to the developing devices 19Y, 19M, 19C, and 19K each contacting the photoconductors 18Y, 18M, 18C, or 18K. As a result, image irregularity caused by deformation of the intermediate transfer belt 15, solidification of toner, and so forth may occur more often.

To solve the above-described problems, the image forming apparatus 100 further includes an insulation device 20 between the fixing device 7, that is, a heat generator, and the intermediate transfer belt 15 provided close to the fixing device 7. A widely-used insulation device often uses airflows generated by ducts. Here, the insulation device 20 uses a heat pipe. Specifically, the insulation device 20 includes a heat receiving plate 21, a heat pipe 22, a heat releasing plate 23, a duct 24, and a discharge fan, not shown. The heat receiving plate 21 serving as a heat receiving member is formed of a material having higher heat absorbing performance, and is provided between the fixing device 7 and a target component to be protected from heat generated by the fixing device 7, that is, the transfer device 2. The heat pipe 22 serving as heat transmission means is attached to a bottom surface of the heat receiving plate 21, and heat is received by a bottom end of the heat pipe 22 (hereinafter referred to as a heat receiving end). The other end of the heat pipe 22 serves as a heat releasing part, and is attached to the heat releasing plate 23 at a position higher than the heat receiving end. The heat releasing plate 23 serving as a heat releasing member is formed of a material having higher heat releasing performance. A heat sink may be provided to the heat releasing plate 23 as needed. According to illustrative embodiments, the duct 24 is extended from a front surface of the image forming apparatus 100 to a back surface thereof, and the heat releasing plate 23 is positioned within the duct 24. An airflow entrance is provided at an end of the duct 24 on the front surface of the image forming apparatus 100, and an airflow exit is provided at the other end of the duct 24 on the back surface of the image forming apparatus 100. The discharge fun, not shown, is provided to the airflow exit. The insulation device 20 having the above-described configuration receives heat from the heat generator, that is, the fixing device 7, using the heat receiving plate 21, and the heat thus received is transmitted to the heat releasing plate 23 by the heat pipe 22. The heat is then released from the heat releasing plate 23 provided within the duct 24, and the heat thus released is discharged from the image forming apparatus 100 by the discharge fan. Alternatively, in a case in which the discharge fan is not provided, the heat may be naturally cooled. Thus, as described above, the image forming units 11Y, 11M, 11C, and 11K, and the transfer device 2 are effectively protected from the heat generated by the fixing device 7. As a result, occurrence of image irregularity including color shift caused by deformation of the intermediate transfer belt 15, solidification of toner, and so forth can be effectively prevented.

In the developing devices 19Y, 19M, 19C, and 19K, when developer agitators for agitating and conveying developer stored in the developing devices 19Y, 19M, 19C, and 19K are driven, a temperature of the developing devices 19Y, 19M, 19C, and 19K is increased due to frictional heat generated by friction between the developer agitators and the developer, and friction within the developer. Further, frictional heat due to friction between the developer and developer restriction members that regulate a thickness of the developer borne on the surface of the developer bearing members to form images before the developer reaches a developing position within the image forming apparatus, and friction within the developer occurring when the thickness of the developer is restricted by the developer restriction members, increases the temperature within the developing devices 19Y, 19M, 19C, and 19K.

When the temperature within the developing device 19Y, 19M, 19C, or 19K is increased, the charge given the toner is decreased, and therefore an amount of toner attached to the recording medium is increased. Consequently, a predetermined image density cannot be reliably obtained. Further, the increase in the temperature of the developing device 19Y, 19M, 19C, or 19K can cause the toner to melt, with the melted toner adhering to the developer restriction members, the developer bearing members, the photoconductor 18Y, 18M, 18C, or 18K, and so forth. Consequently, irregular images having undesired lines may be formed. In particular, when recently-used toner having a lower melting temperature is used in an effort to reduce fixing energy, irregular images caused by adhesion of the toner occur more often. Further, a developing device installed in a recently used image forming apparatus providing higher printing speed tends to heat up more easily.

In order to provide higher image quality and better reliability, it is important to prevent an excessive temperature increase of the developing devices 19Y, 19M, 19C, and 19K. In a related-art image forming apparatus, airflows are generated around developing devices using an air-cooling fan or the like to cool the developing devices and prevent an excessive increase in the temperature of the developing devices. However, increasing demands for downsizing of the image forming apparatus requires a more compact duct for forming airflows around the developing devices. When the duct is downsized, the airflow around the developing devices is reduced, and consequently, the developing devices are not sufficiently cooled.

To solve the above-described problems, in the image forming apparatus 100 according to illustrative embodiments, the developing devices 19Y, 19M, 19C, and 19K are cooled using a liquid cooling device 30.

Figure 5:
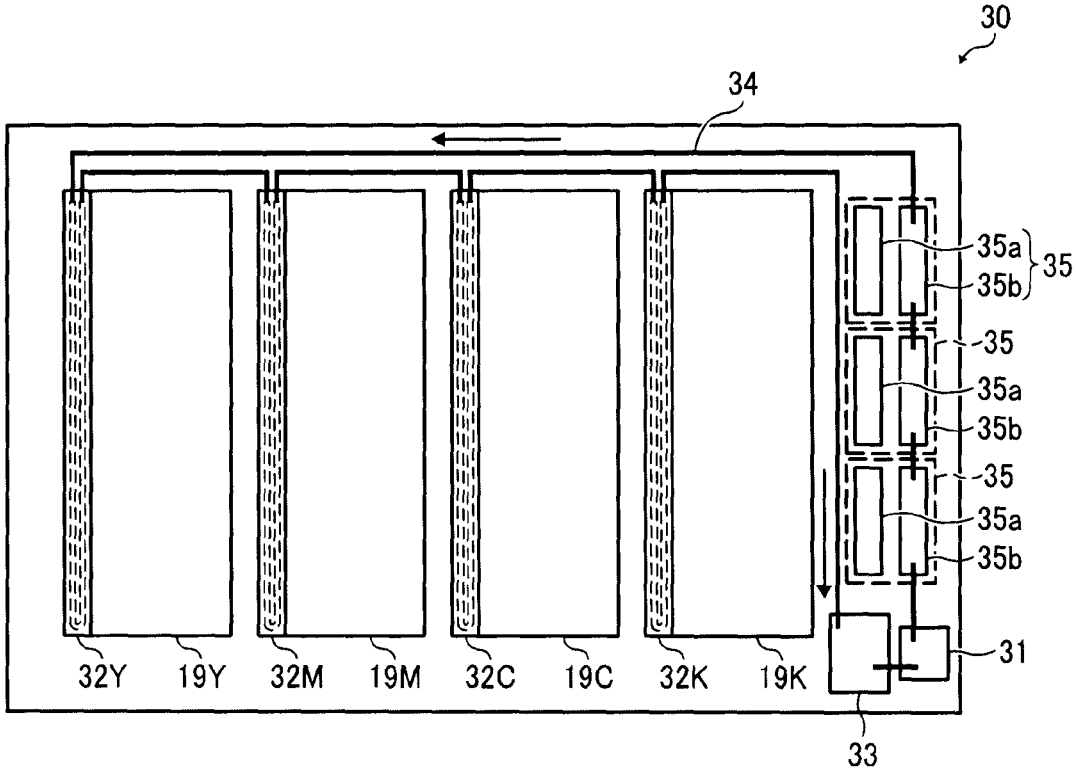
FIG. 5 is a schematic view illustrating an example of a configuration of a liquid cooling device according to illustrative embodiments.

FIG. 5 is a schematic view illustrating an example of a configuration of the liquid cooling device 30.

The liquid cooling device 30 is pressed against a wall surface of each of the developing devices 19Y, 19M, 19C, and 19K, that is, a portion where a temperature increase occurs. Referring to FIG. 5, the liquid cooling device 30 includes four heat receiving parts 32Y, 32M, 32C, and 32K in which a cooling liquid inside the heat receiving parts 32Y, 32M, 32C, and 32K receives heat from the developing devices 19Y, 19M, 19C, and 19K, three cooling units 35 serving as cooling means for cooling the cooling liquid, a circulation pipe 34 that allows the cooling liquid to circulate between the heat receiving parts 32Y, 32M, 32C, and 32K and the cooling units 35, a cooling pump 31 serving as conveyance means for circulating the cooling liquid within the circulation pipe 34, a reserve tank 33 for storing an extra amount of the cooling liquid, and so forth. Each of the cooling units 35 includes a cooling fan 35*a* and a radiator 35*b* serving as heat releasing means.

Figure 6:
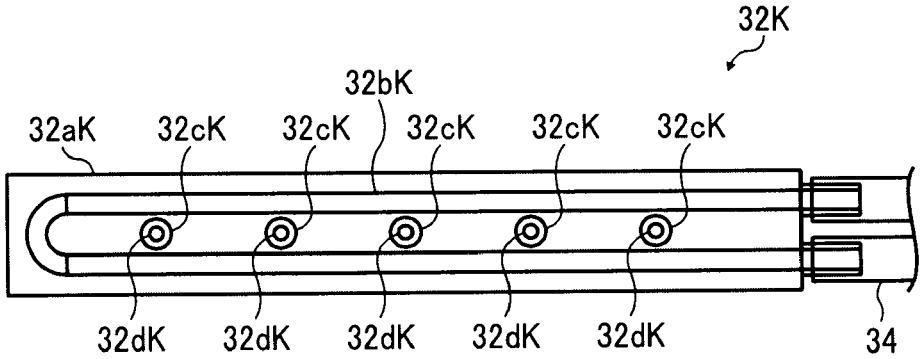
FIG. 6 is a schematic view illustrating a heat receiving part.

FIG. 6 is a schematic view illustrating the heat receiving part 32K. It is to be noted that the heat receiving parts 32Y, 32M, and 32C also have the same configuration as that of the heat receiving part 32K to be described in detail below.

The heat receiving part 32K includes a casing 32*a*K formed of a material having higher heat conductivity, and a duct 32*b*K formed of a material having higher heat conductivity. The duct 32*b*K is provided within the casing 32*a*K. Generally, the casing 32*a*K and the duct 32*b*K are mainly formed of copper having a heat conductivity of about 400 [W/mK], or aluminum having a heat conductivity of about 200 [W/mK]. Alternatively, the casing 32*a*K and the duct 32*b*K may be formed of a material having a higher heat conductivity, such as silver or gold. The circulation pipe 34 includes a flexible member such as a rubber tube or a resin tube, and is connected to a leading edge of the duct 32*b*K. The heat receiving part 32K is movably supported in a direction of attachment/detachment of the image forming unit 11K by a contact/separation mechanism 40K to be described later. Therefore, the circulation pipe 34 including the flexible member described above can follow movement of the heat receiving part 32K, thereby preventing the circulation pipe 34 from detaching from the duct 32*b*K. It is to be noted that, alternatively, a part of the circulation pipe 34 may be formed of a metal tube in order to minimize moisture permeability of the circulation pipe 34.

Figure 10:
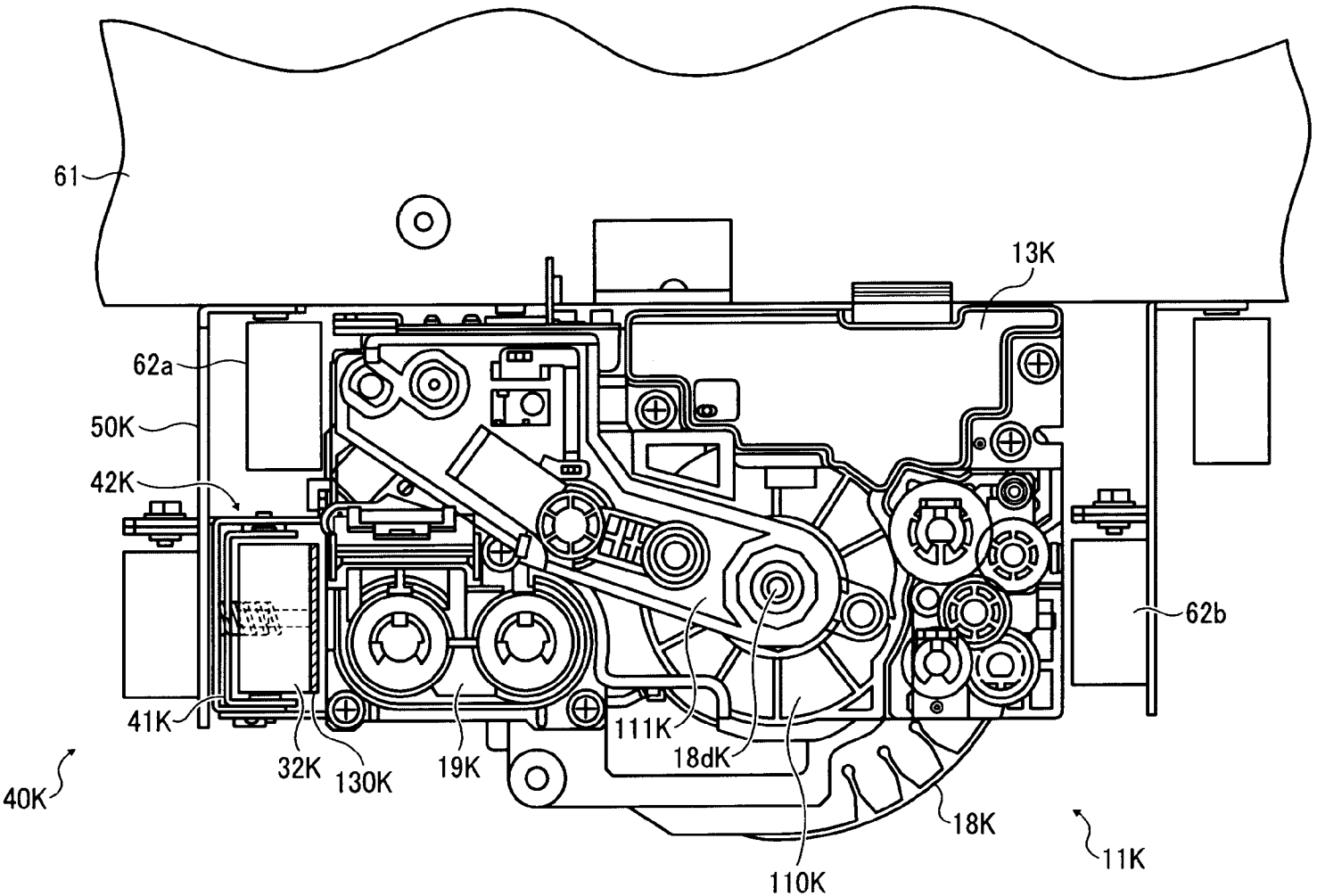
FIG. 10 is a schematic view illustrating a configuration around the image forming unit for a color of black according to a first illustrative embodiment when viewed from the front.

Because lateral surfaces of the developing device 19K are also formed of a material having higher heat conductivity such as aluminum or copper, an airspace is formed between the developing device 19K and the heat receiving part 32K when the heat receiving part 32K is caused to contact the lateral surface of the developing device 19K, reducing heat exchange efficiency. In order to prevent the reduction of the heat exchange efficiency, according to illustrative embodiments, a heat conductive sheet 130K is attached to a surface of the heat receiving part 32K facing the developing device 19K (hereinafter referred to as a contact surface) as illustrated in FIG. 10. The heat conductive sheet 130K is required to have high heat conductivity and flexibility to reduce profile irregularity between the developing device 19K and the heat receiving part 32K. However, the heat conductive sheet 130K having higher heat conductivity tends to be hard. By contrast, the heat conductive sheet 130K having lower heat conductivity tends to be flexible. In order to provide higher heat conductivity to the heat conductive sheet 130K, it is inevitable that the heat conductive sheet 130K has a certain level of rigidity. Therefore, the heat receiving part 32K is pressed hard against the lateral surface of the developing device 19K to cause the heat receiving part 32K to closely contact the developing device 19K. Accordingly, even the heat conductive sheet 130K having a certain level of rigidity can be deformed and profile irregularity between the developing device 19K and the heat receiving part 32K is reduced. As a result, appearance of an airspace formed between the developing device 19K and the heat receiving part 32K is prevented, preferably transmitting the heat from the developing device 19K to the heat receiving part 32K substantially directly. It is to be noted that, alternatively, the heat conductive sheet 130K may be attached to the lateral surface of the developing device 19K.

Returning to FIG. 5, each of the cooling units 35 includes the radiator 35*b* serving as the heat releasing means for releasing heat from the cooling liquid via a storage. The storage is formed of a material having higher heat conductivity such as aluminum, and stores the cooling liquid conveyed from the circulation pipe 34. The radiator 35*b* is either cooled using the cooling fan 35*a* or naturally cooled without the cooling fan 35*a* depending on an amount of heat to be released. A number of the cooling units 35 may be one or four or more. Although the cooling fan 35*a* is provided to each of the cooling units 35 according to illustrative embodiments, a single cooling fan may be used to supply air to the radiators 35*b* of all the cooling units 35. It is to be noted that provision of the multiple cooling units 35 preferably prevents an increase in the temperature of all the developing devices 19Y, 19M, 19C, and 19K even when cooling efficiency of each of the cooling units 35 is low. As a result, a more compact radiator having a smaller heat releasing area and lower cooling efficiency can be used, downsizing the cooling units 35 as compared with a case in which the single cooling unit 35 is used to prevent a temperature increase of all the developing devices 19Y, 19M, 19C, and 19K.

The cooling pump 31 serves as a drive source to circulate the cooling liquid over the heat receiving parts 32Y, 32M, 32C, and 32K and the cooling units 35 in a direction as indicated by arrows in FIG. 5. The reserve tank 33 is a tank for storing the cooling liquid. The cooling liquid serves as a heat transporting medium to transport the heat received by the heat receiving parts 32Y, 32M, 32C, and 32K to the radiators 35*b*. The cooling liquid contains water as the main ingredient, and propylene glycol, ethylene glycol, or the like is added in order to reduce a freezing temperature, and an antirust agent, for example, a phosphate material such as potassium phosphate and inorganic potassium chloride, may be added in order to prevent metal components from rusting. In a case in which water is used as the cooling liquid, a larger amount of heat can be transported with a smaller amount of water because a constant volume heat capacity of water is more than 3,000 times greater than that of air. As a result, the cooling liquid can cool the developing devices 19Y, 19M, 19C, or 19K more efficiently as compared with a case in which air is used.

Figure 7:
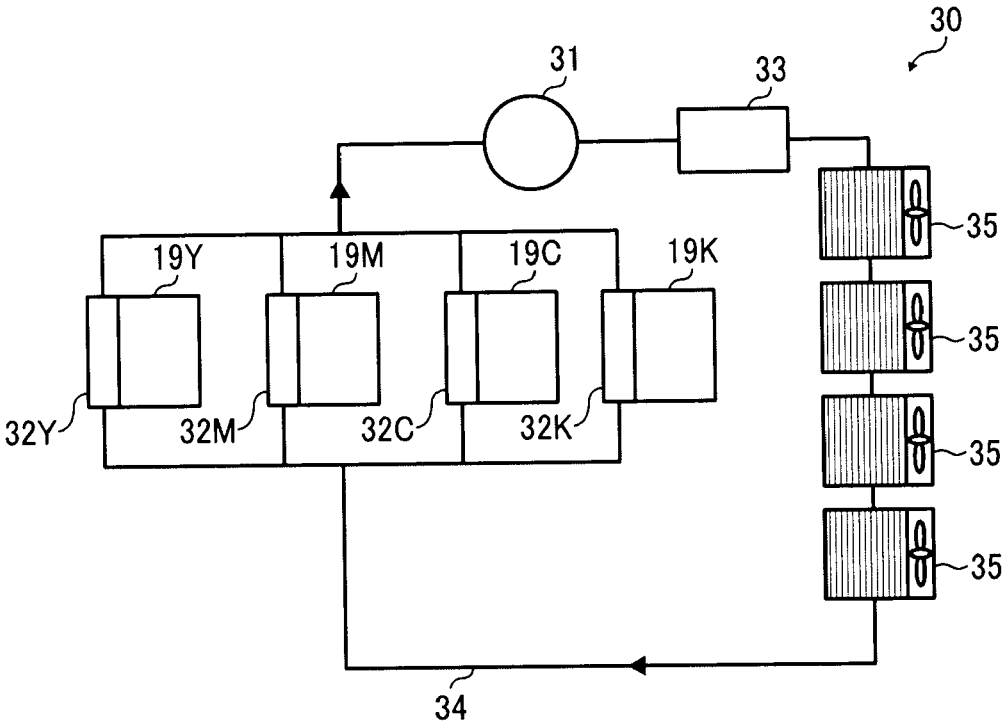
FIG. 7 is a schematic view illustrating another example of the configuration of the liquid cooling device.
Figure 8:
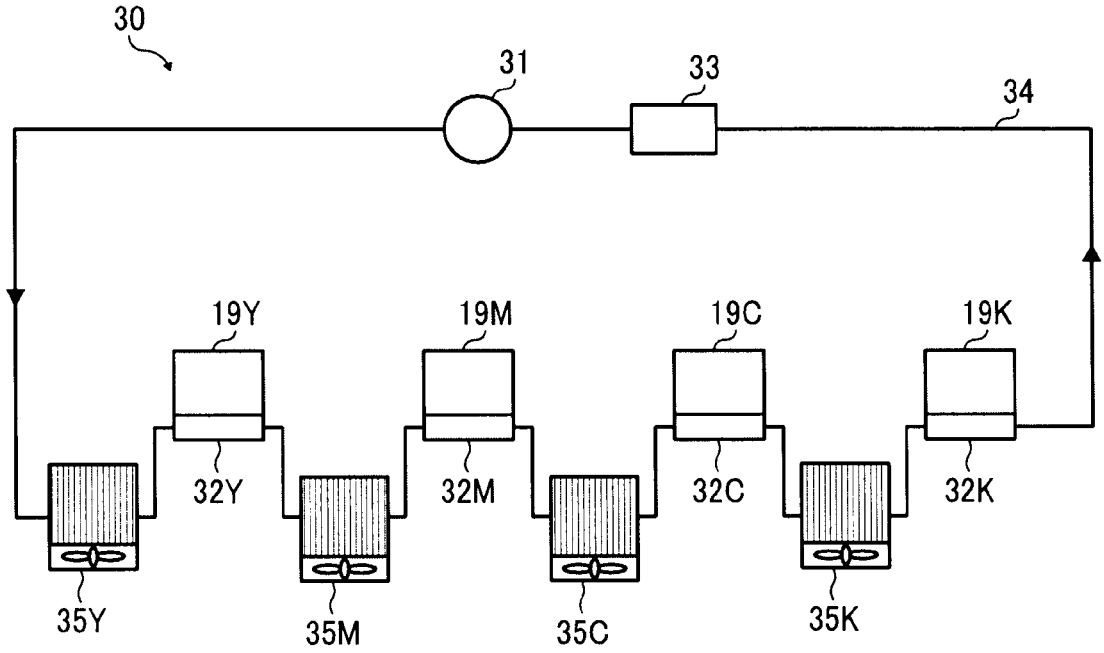
FIG. 8 is a schematic view illustrating yet another example of the configuration of the liquid cooling device.
Figure 9:
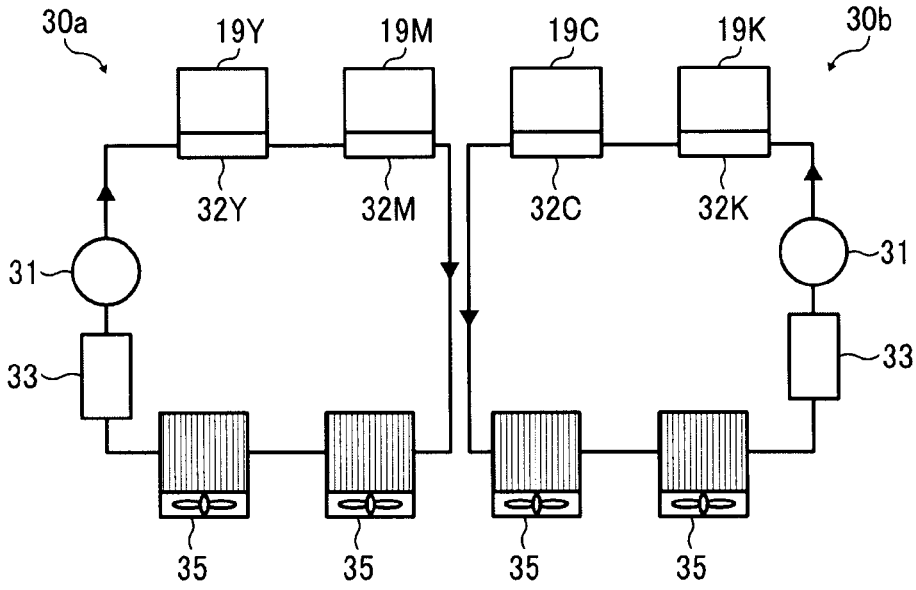
FIG. 9 is a schematic view illustrating still yet another example of the configuration of the liquid cooling device.

Although the cooling liquid cooled at the radiators 35*b* is sequentially conveyed to the heat receiving parts 32Y, 32M, 32C, and 32K, the reserve tank 33, and the cooling pump 31, in that order, and then returned to the radiators 35*b* as illustrated in FIG. 5, a configuration of the liquid cooling device 30 is not particularly limited to the above-described configuration. Alternatively, for example, the heat receiving parts 32Y, 32M, 32C, and 32K may be connected to one another in parallel as illustrated in FIG. 7. Further alternatively, as illustrated in FIG. 8, four cooling units 35Y, 35M, 35C, and 35K are provided corresponding to the developing devices 19Y, 19M, 19C, and 19K, respectively, and the circulation pipe 34 is configured such that the cooling liquid cooled at the cooling unit 35Y, 35M, 35C, or 35K is not conveyed to those of the heat receiving parts 32Y, 32M, 32C, or 32K which do not correspond to the developing device 19Y, 19M, 19C, or 19K while the cooling liquid is conveyed to that heat receiving part 32Y, 32M, 32C, or 32K corresponding to the developing device 19Y, 19M, 19C, or 19K. Yet further alternatively, as illustrated in FIG. 9, a first liquid cooling device 30*a* for cooling the developing devices 19Y and 19M and a second liquid cooling device 30*b* for cooling the developing devices 19C and 19K are provided to cool the respective developing devices. The configuration of the liquid cooling device is determined based on an amount of heat to be cooled by the heat receiving parts 32Y, 32M, 32C, and 32K, and temperature conditions, that is, thermal design conditions.

It is to be noted that, although the liquid cooling device 30 using the cooling liquid is employed to cool the developing devices 19Y, 19M, 19C, and 19K according to illustrative embodiments, alternatively, a cooling device using a cooling medium such as air may be employed in place of the liquid cooling device 30.

A description is now given of a contact/separation mechanism according to a first illustrative embodiment. It is to be noted that the contact/separation mechanism 40K that causes the heat receiving part 32K to contact or separate from the developing device 19K is to be described in detail below as a representative example, and contact/separation mechanisms corresponding to the developing devices 19Y, 19M, and 19C have the same configuration as that of the contact/separation mechanism 40K.

The heat receiving part 32K needs to be pressed against the lateral surface of the developing device 19K in order to efficiently cool the developing device 19K. As a result, a large amount of pressure is applied to the developing device 19K, and the pressure also acts on the front and back positioning plates 111K and 112K, possibly deforming the front and back positioning plates 111K and 112K. Further, when the front and back positioning plates 111K and 112K are deformed, the developing gap may vary. Because any error in the developing gap must be minimized, even a slight variation in the developing gap due to slight deformation of the front and back positioning plates 111K and 112K may affect image quality. Conversely, however, when an amount of pressure applied from the heat receiving part 32K to the developing device 19K is reduced, the heat receiving part 32K cannot closely contact the developing device 19K, degrading cooling efficiency. To solve such problems, according to illustrative embodiments, when the heat receiving part 32K is pressed against the developing device 19K, the contact/separation mechanism 40K fixedly engages with the developing device 19K to prevent the pressure applied from the heat receiving part 32K to the lateral surface of the developing device 19K from being a force external to the developing device 19K. Accordingly, the pressure applied to the developing device 19K from the heat receiving part 32K is prevented from acting on the front and back positioning plates 111K and 112K. The above-described configuration is described in detail below.

Figure 11:
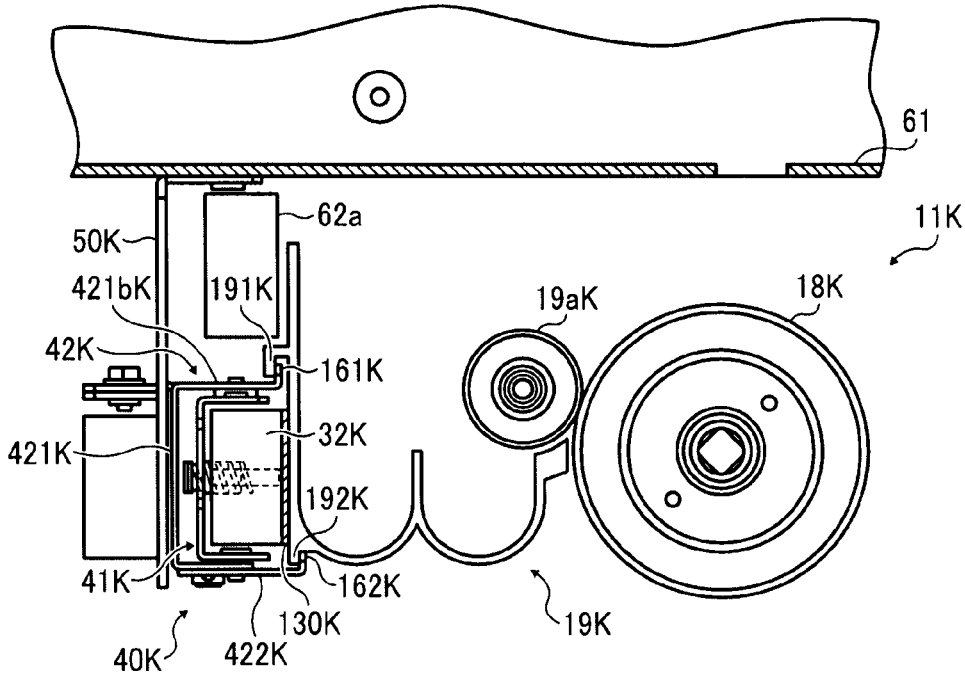
FIG. 11 is a vertical cross-sectional view illustrating the configuration around the image forming unit illustrated in FIG. 10.

FIG. 10 is a schematic view illustrating a configuration around the image forming unit 11K of the image forming apparatus 100 according to the first illustrative embodiment when viewed from the front. FIG. 11 is a cross-sectional view illustrating the configuration around the image forming unit 11K illustrated in FIG. 10.

Referring to FIGS. 10 and 11, the image forming apparatus 100 includes contractible rails 62*a* and 62*b*. The image forming unit 11K is fitted in the rails 62*a*, 62*b* and the drum shaft 18*d*K, and is slid into the image forming apparatus 100. Accordingly, the image forming unit 11K is attached to the image forming apparatus 100.

As illustrated in FIG. 10, the contact/separation mechanism 40K for causing the heat receiving part 32K to closely contact or separate from the developing device 19K is provided adjacent to the developing device 19K.

The contact/separation mechanism 40K includes a retainer 41K serving as holding means for holding the heat receiving part 32K, and a supporter 42K serving as supporting means for supporting the retainer 41K such that the retainer 41K can approach or separate from the developing device 19K. The supporter 42K is fixed to a fixed member 50K to which the rail 62*a* is attached. The fixed member 50K is fixed to a partition plate 61 that separates the image forming part 1 from a writing position where the irradiation device 9 is provided.

As illustrated in FIG. 10, the retainer 41K faces three surfaces of the heat receiving part 32K, that is, a surface opposite the contact surface of the heat receiving part 32K, and top and bottom surfaces of the heat receiving part 32K. Accordingly, the retainer 41K covers the heat receiving part 32K to protect the heat receiving part 32K from infrared light from the fixing device 7 and so forth, thereby preventing the heat receiving part 32K from being thermally affected by components other than the developing device 19K. As a result, the heat receiving part 32K is prevented from being heated by components other than the developing device 19K, thereby contributing to efficiently cooling the developing device 19K.

Figure 12:
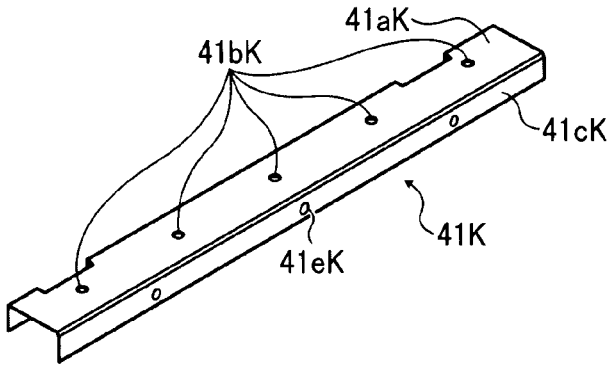
FIG. 12 is a perspective view illustrating a retainer.
Figure 13:
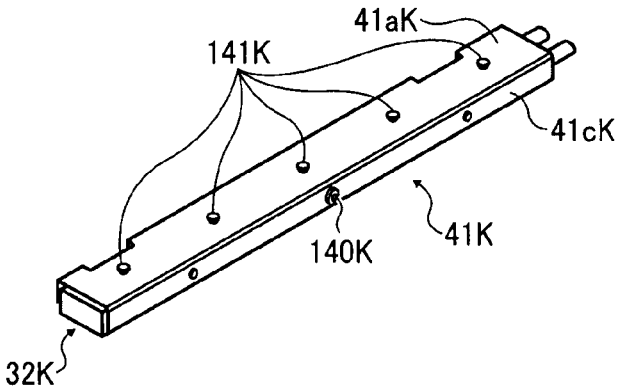
FIG. 13 is a perspective view illustrating the retainer and a heat receiving part.
Figure 14:
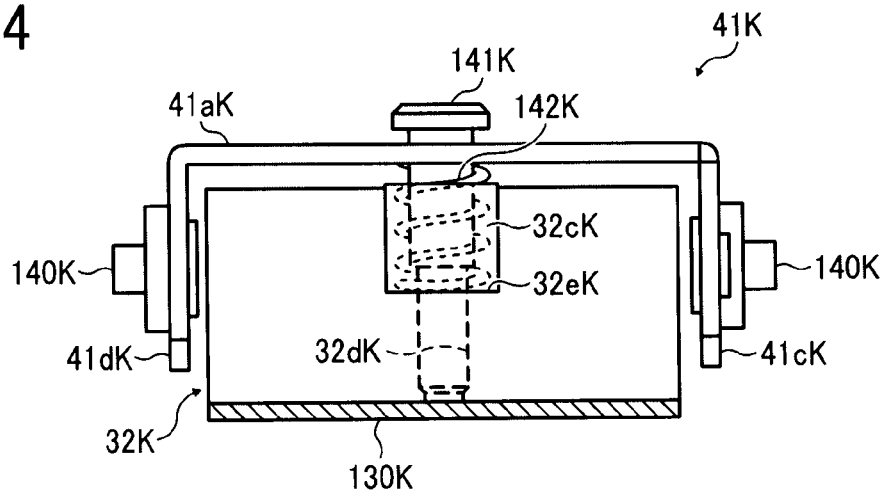
FIG. 14 is a schematic view illustrating the retainer and the heat receiving part when viewed from the front.
Figure 15:
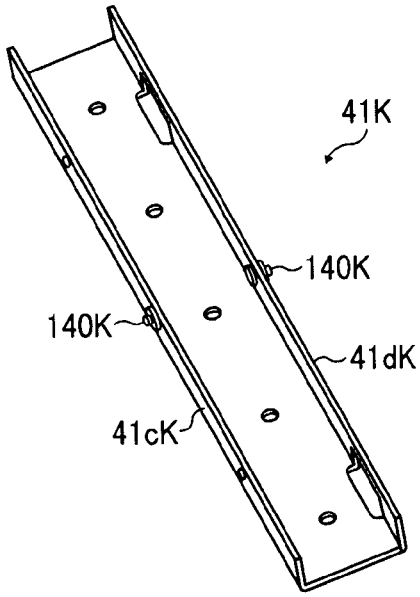
FIG. 15 is a perspective view illustrating the retainer into which engaging pins are swaged.

FIG. 12 is a perspective view illustrating just the retainer 41K. FIG. 13 is a perspective view illustrating the retainer 41K and the heat receiving part 32K. FIG. 14 is a schematic view illustrating the retainer 41K and the heat receiving part 32K when viewed from the front. FIG. 15 is a perspective view illustrating the retainer 41K into which engaging pins 140K are swaged as viewed from the interior of the contact/separation mechanism 40K.

As illustrated in FIG. 12, the retainer 41K is a bent metal sheet, and has five holes 41*b*K provided on an opposing part 41*a*K that faces a surface opposite the contact surface of the heat receiving part 32K at approximately equal spaced intervals between one another in a longitudinal direction of the retainer 41K. An engaging hole 41*e*K is provided at the center in a longitudinal direction of each of first and second parts 41*c*K and 41*d*K. The first and second parts 41*c*K and 41*d*K are respectively formed by bending both edges of the opposing part 41*a*K in a latitudinal direction. As illustrated in FIG. 15, an engaging pin 140K is swaged into each of the engaging holes 41*e*K.

Figure 16:
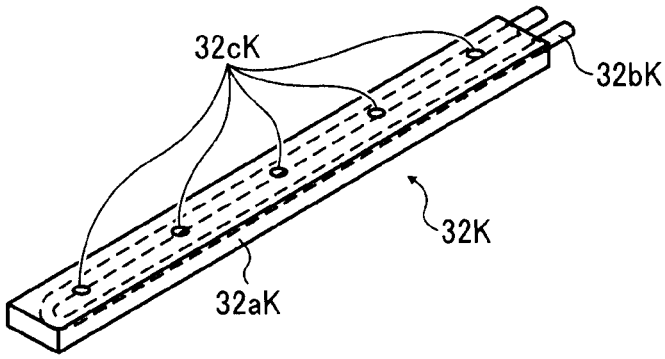
FIG. 16 is a perspective view illustrating the heat receiving part.

FIG. 16 is a perspective view illustrating the heat receiving part 32K. As illustrated in FIG. 16, five round notches 32*c*K are formed on the heat receiving part 32K corresponding to the five holes 41*b*K provided on the opposing part 41*a*K of the retainer 41K. Each of the round notches 32*c*K has a screw hole 32*d*K at the center of a bottom surface thereof as illustrated in FIGS. 6 and 14. Referring to FIG. 14, shoulder screws 141K movably engage with the five holes 41*b*K provided on the opposing part 41*a*K of the retainer 41K, respectively, so that a screw portion of each of the shoulder screws 141K is screwed into each of the screw holes 32*d*K provided on the heat receiving part 32K. A coil spring 142K serving as pressing means including an elastic member is twisted around a shoulder portion of each of the shoulder screws 141K. One end of each of the coil springs 142K contacts the opposing part 41*a*K of the retainer 41K, and the other end thereof contacts a bottom portion 32*e*K (hereinafter also referred to as an elastic member contact portion) of each of the round notches 32*c*K. Accordingly, the heat receiving part 32K is pressed against the developing device 19K by the coil springs 142K while being held by the retainer 41K. As illustrated in FIG. 14, the heat receiving part 32K is held by the retainer 41K with a predetermined space between the surface opposite the contact surface of the heat receiving part 32K and the opposing part 41*a*K. As a result, when the heat receiving part 32K closely contacts the lateral surface of the developing device 19K, the heat receiving part 32K can be moved relative to the retainer 41K, so that the heat receiving part 32K can be preferably pressed against the developing device 19K. It is to be noted that the heat receiving part 32K is held such that the contact surface of the heat receiving part 32K protrudes from a leading edge of each of the first and second parts 41$c$K and 41$d$K of the retainer 41K. Accordingly, when the heat receiving part 32K is pressed against the developing device 19K, the leading edges of the first and second parts 41$c$K and 41$d$K are prevented from contacting the developing device 19K.

An amount of force to press the heat receiving part 32K against the developing device 19K (hereinafter referred to as a pressing force of the heat receiving part 32K) can be easily changed by changing the type of the coil springs 142K used in the arrangement described above.

As described above, the round notch 32$c$K is provided on the heat receiving part 32K, and the bottom portion 32$e$K of the round notch 32$c$K serving as the elastic member contact portion of the heat receiving part 32K is recessed from the surface opposite the contact surface of the heat receiving part 32K toward the developing device 19K. Accordingly, a distance between the opposing part 41$a$K of the retainer 41K and the bottom portion 32$e$K is larger than a distance between the opposing part 41$a$K and the surface opposite the contact surface of the heat receiving part 32K. As a result, changes in a force of the coil springs 142K to press the heat receiving part 32K against the developing device 19K due to variation in length of the coil springs 142K and so forth can be reduced. Further, the distance between the opposing part 41$a$K and the surface opposite the contact surface of the heat receiving part 32K can be reduced, thereby downsizing the contact/separation mechanism 40K.

According to illustrative embodiments, the heat receiving part 32K is elastically held at even intervals in the longitudinal direction thereof, so that the heat receiving part 32K can be evenly pressed against the developing device 19K.

Returning to FIG. 12, according to illustrative embodiments, the five holes 41$b$K provided on the opposing part 41$a$K of the retainer 41K are arranged in a line in the longitudinal direction of the retainer 41K. Alternatively, the five holes 41$b$K may be arranged in a zigzag pattern. In addition, although the heat receiving part 32K is elastically held at five positions as described above, alternatively, the heat receiving part 32K may be elastically held at any number of positions as long as the contact surface of the heat receiving part 32K is evenly pressed against the developing device 19K. In a case in which a sufficient distance can be provided between the opposing part 41$a$K and the surface opposite the contact surface of the heat receiving part 32K, the round notches 32$c$K need not be provided to the heat receiving part 32K. As described above, according to illustrative embodiments, the coil springs 142K including an elastic member are used to supply the force to press the heat receiving part 32K against the developing device 19K. Alternatively, a leaf spring or an elasticity-recoverable sponge may be used in place of the coil springs 142K. In a case in which such a sponge is used in place of the coil springs 142K, the sponge is bonded to both the heat receiving part 32K and the retainer 41K with an adhesive agent, so that the heat receiving part 32K is held by the retainer 41K using the sponge without using the shoulder screws 141K.

Figure 17:
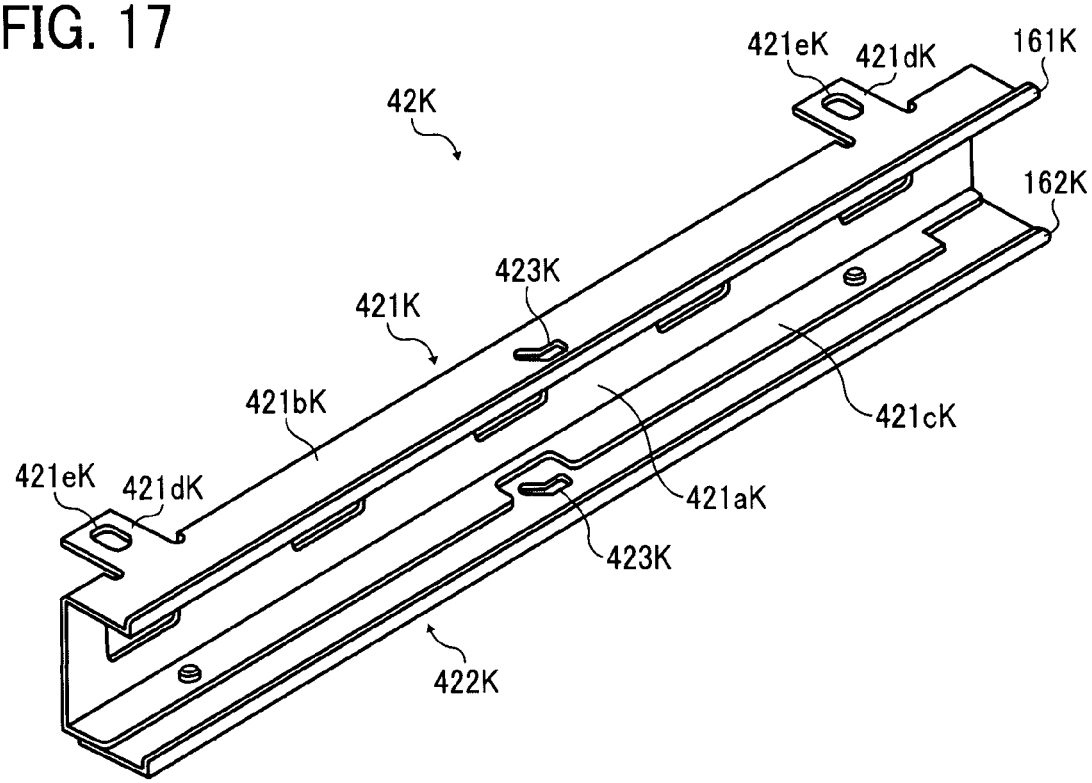
FIG. 17 is a perspective view illustrating the supporter.
Figure 18:
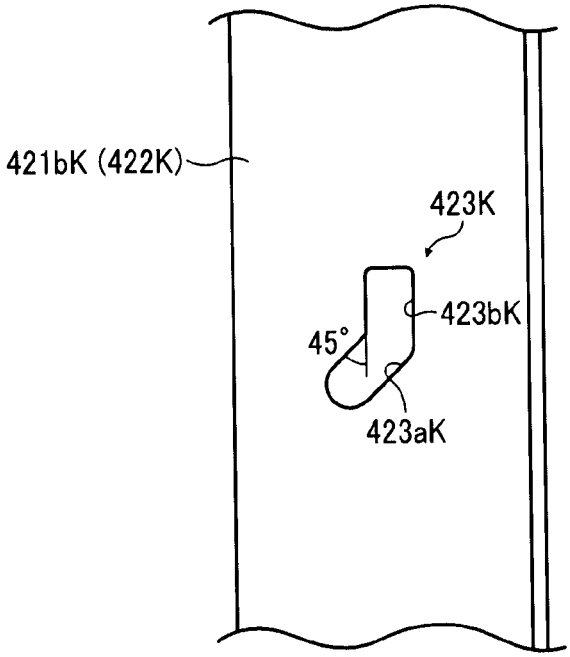
FIG. 18 is a schematic view illustrating an example of an engaging hole.

FIG. 17 is a perspective view illustrating the supporter 42K. The supporter 42K includes a first member 421K and a second member 422K. The first member 421K has a back face 421$a$K, a support part 421$b$K, and a fixing part 421$c$K. The first member 421K is formed by bending a metal sheet or the like. An edge of the back face 421$a$K in a latitudinal direction of the supporter 42K is bent to form the support part 421$b$K and the fixing part 421$c$K. A mounting part 421$d$K is provided near both ends of the support part 421$b$K in a longitudinal direction of the supporter 42K, and a slot or elongated hole 421$e$K is formed at a substantial center of each of the mounting parts 421$d$K. A screw hole is provided near both ends of the fixing part 421$c$K of the first member 421K in a longitudinal direction of the supporter 42K so that the second member 422K can be screwed onto the first member 421K. An engaging hole 423K is provided at both the center of the support part 421$b$K of the first member 421K in the longitudinal direction of the supporter 42K and the center of the second member 422K in the longitudinal direction thereof so that the engaging pin 140K of the retainer 41K engages with the engaging hole 423K. As illustrated in FIG. 18, the engaging hole 423K has a guide part 423$a$K slanted 45° relative to the longitudinal (long) direction of the supporter 42K, that is, a direction of attachment/detachment of the developing device 19K, and a locking part 423$b$K extending parallel to the longitudinal edges of the supporter 42K.

After the engaging pin 140K swaged into the engaging hole 41$e$K of the first part 41$c$K of the retainer 41K engages with the engaging hole 423K of the support part 421$b$K, the engaging pin 140K swaged into the engaging hole 41$e$K of the second part 41$d$K of the retainer 41K is caused to engage with the engaging hole 423K of the second member 422K. Thereafter, the second member 422K is screwed onto the fixing part 421$c$K of the first member 421K so that the retainer 41K is supported by the supporter 42K.

According to illustrative embodiments, the support part 421$b$K of the first member 421K is provided at the top of the supporter 42K as illustrated in FIG. 11. Alternatively, the support part 421$b$K of the first member 421K may be provided at the bottom of the supporter 42K. In addition, although the second member 422K is screwed onto the fixing part 421$c$K of the first member 421K according to illustrative embodiments, alternatively, the second member 422K may be attached to the fixing part 421$c$K by rivets, welding, or the like. However, in view of maintenance of the heat receiving part 32K, it is preferable that the second member 422K be screwed onto the fixing part 421$c$K so that the first member 421K and the second member 422K can be easily separated from each other.

As illustrated in FIG. 17, a first engaging part 161K extending in the longitudinal direction of the supporter 42K and bent upward is provided at an edge of the support part 421$b$K of the first member 421K. A second engaging part 162K extending in the longitudinal direction of the supporter 42K and bent upward is provided at an edge of the second member 422K.

As illustrated in FIG. 11, a first engaged part 191K is provided on the lateral surface of the developing device 19K in the longitudinal direction thereof. The first engaged part 191K has a portion protruding from the lateral surface of the developing device 19K that is hereinafter referred to as a protrusion and a portion extending downward from a leading edge of the protrusion. A second engaged part 192K protruding from the bottom surface of the developing device 19K is provided at a heat receiving part 32K-side edge on the bottom surface of the developing device 19K in the longitudinal direction of the developing device 19K. The first engaging part 161K is positioned closer to the photoconductor 18K than the first engaged part 191K, and faces the first engaged part 191K. The second engaging part 162K is positioned closer to the photoconductor 18K than the second engaged part 192K, and faces the second engaged part 192K.

Figure 19:
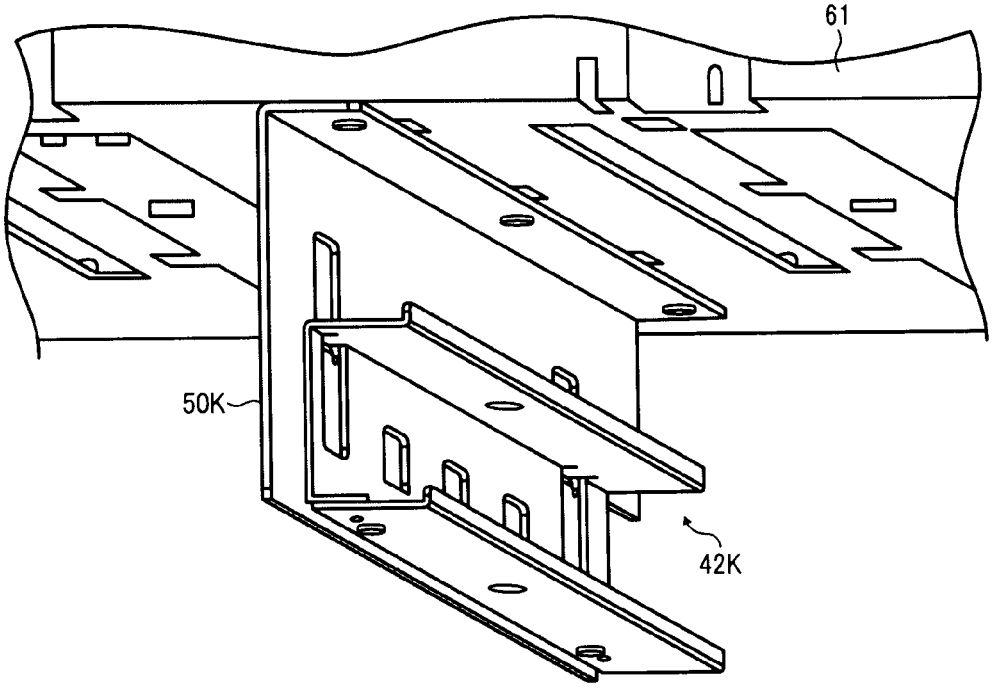
FIG. 19 is a partial and enlarged perspective view illustrating a fixed member and the supporter when viewed from the front.
Figure 20:
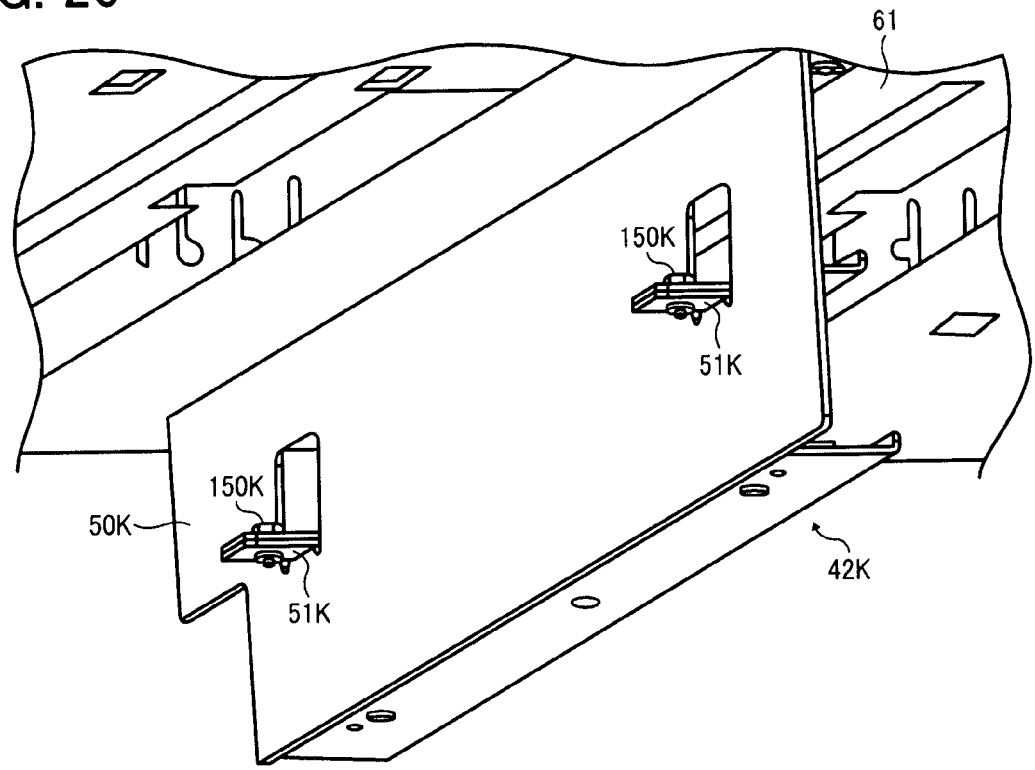
FIG. 20 is a partial and enlarged perspective view illustrating the fixed member and the supporter when viewed from the back.

FIG. 19 is a partial and enlarged perspective view illustrating the fixed member 50K and the supporter 42K when viewed from the front. FIG. 20 is a partial and enlarged perspective view illustrating the fixed member 50K and the supporter 42K when viewed from the back.

As illustrated in FIG. 19, the supporter 42K is fixed to the fixed member 50K screwed onto the partition plate 61 at three positions. Specifically, a shoulder screw 150K movably engages with the elongated hole 421*e*K at the mounting part 421*d*K of the supporter 42K, and a screw portion of the shoulder screw 150K is screwed into a screw hole, not shown, provided at substantially a center of a fixed base 51K provided near both ends of the fixed member 50K in a longitudinal direction of the fixed member 50K as illustrated in FIG. 20. Further, the supporter 42K is fixed to the fixed member 50K such that a space is formed between the back face 421*a*K of the supporter 42K and the fixed member 50K. Accordingly, the supporter 42K is swingably fixed to the fixed member 50K in a direction parallel to a direction in which a force of the coil spring 142K that presses the heat receiving part 32K (hereinafter referred to as a pressing force of the coil spring 142K) is exerted. Because the supporter 42K can be moved in the direction parallel to the direction of the pressing force of the coil spring 142K as described above, the first and second engaging parts 161K and 162K are prevented from getting stuck in the first and second engaged parts 191K and 192K as described in detail later when the developing device 19K is attached to or detached from the image forming apparatus 100. Accordingly, the developing device 19K can be smoothly attached to and detached from the image forming apparatus 100. Further, also as described in detail later, when the coil spring 142K presses the developing device 19K via the heat receiving part 32K, the supporter 42K receives a reactive force from the developing device 19K so that the supporter 42K can be moved in a direction separating from the developing device 19K. As a result, the first and second engaging parts 161K and 162K engage with the first and second engaged parts 191K and 192K, respectively, so that the contact/separation mechanism 40K can be attached to the developing device 19K.

A description is now given of contact and separation of the heat receiving part 32K to and from the developing device 19K using the contact/separation mechanism 40K described above.

Figure 21:
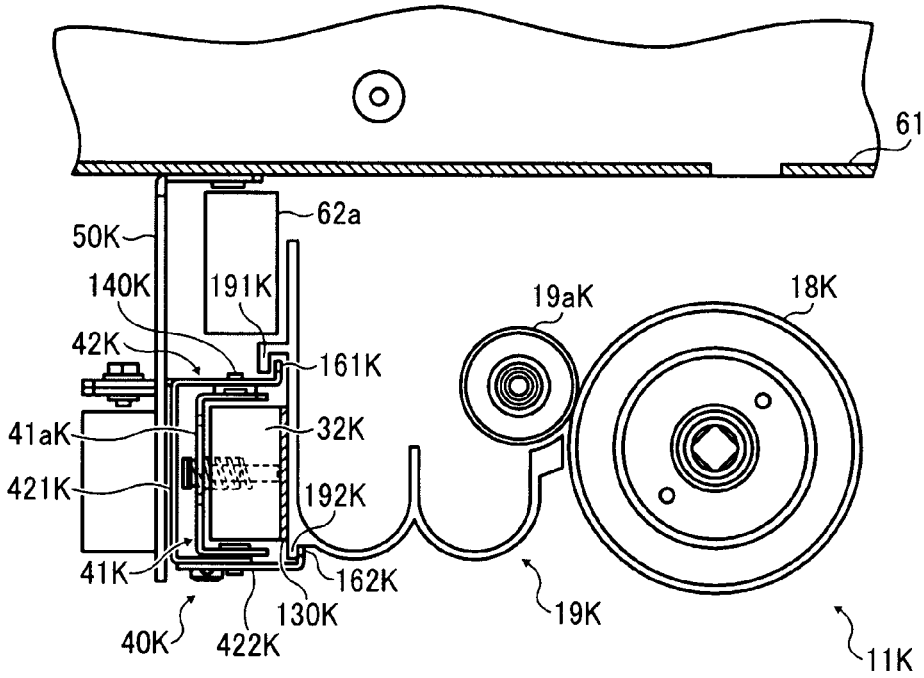
FIG. 21 is a vertical cross-sectional view illustrating a state in which the heat receiving part is pressed against the developing device.
Figure 22:
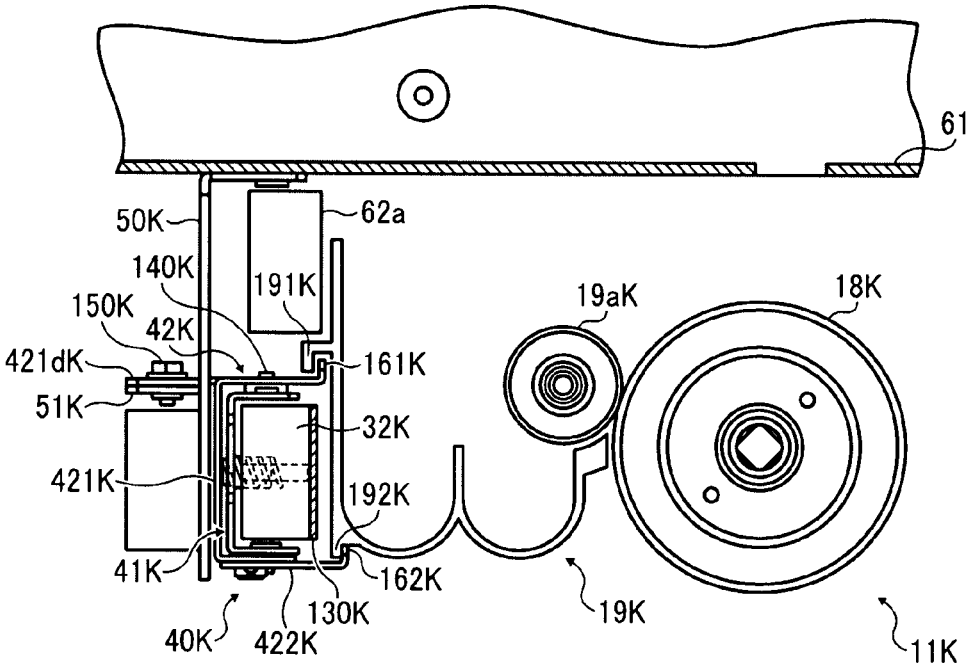
FIG. 22 is a vertical cross-sectional view illustrating a state in which the heat receiving part is separated from the developing device.

FIG. 21 is a vertical cross-sectional view illustrating a state in which the heat receiving part 32K is pressed against the developing device 19K. FIG. 22 is a vertical cross-sectional view illustrating a state in which the heat receiving part 32K is separated from the developing device 19K.

When the image forming unit 11K is detached from the image forming apparatus 100, a lever, not shown, provided on the front side of the image forming apparatus 100 is operated to move the retainer 41K to the front side of the image forming apparatus 100. When the retainer 41K is moved to the front side of the image forming apparatus 100, the engaging pin 140K of the retainer 41K is moved from the locking part 423*b*K of the engaging hole 423K to the guide part 423*a*K. When the engaging pin 140K is moved to the guide part 423*a*K, the engaging pin 140K of the retainer 41K is guided to the guide part 423*a*K of the engaging hole 423K so that the retainer 41K is moved relative to the supporter 42K in the direction separating from the developing device 19K. As a result, the heat receiving part 32K held by the retainer 41K is separated from the developing device 19K. When the engaging pin 140K contacts an end of the guide part 423*a*K, the heat receiving part 32K is completely separated from the developing device 19K as illustrated in FIG. 22. The image forming unit 11K is withdrawn from the image forming apparatus 100 while the heat receiving part 32K is separated from the developing device 19K. When the image forming unit 11K is withdrawn from the image forming apparatus 100, the heat receiving part 32K is separated from the developing device 19K as described above so that no force is applied from the heat receiving part 32K to the developing device 19K. Further, the first and second engaging parts 161K and 162K are released from the first and second engaged parts 191K and 192K, respectively, so that the first and second engaging parts 161K and 162K and the first and second engaged parts 191K and 192K can be moved relative to each other, respectively, in the direction of attachment/detachment of the developing device 19K. Accordingly, the image forming unit 11K can be easily detached from the image forming apparatus 100. Further, scraping between the heat conductive sheet 130K and the developing device 19K can be prevented when the image forming unit 11K is detached from the image forming apparatus 100, thereby preventing the heat conductive sheet 130K from being damaged.

Figure 23:
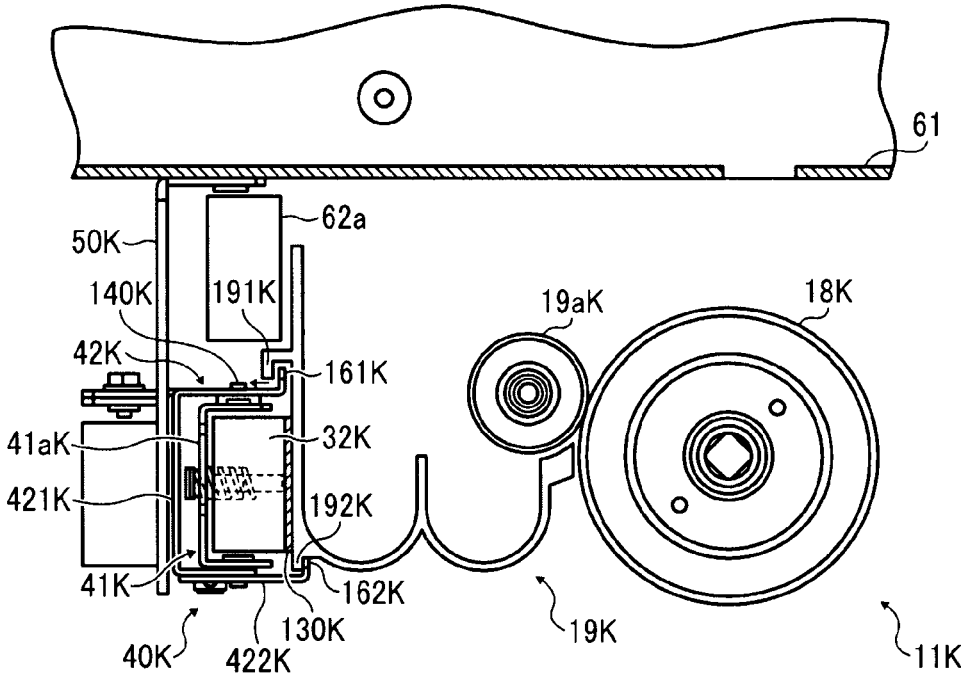
FIG. 23 is a cross-sectional view illustrating a state in which engaging parts and engaged parts engage with each other, respectively.

When the image forming unit 11K is attached to the image forming apparatus 100 after, for example, replacement of the components of the image forming unit 11K, the lever, not shown, is operated to move the retainer 41K to the back side of the image forming apparatus 100. Accordingly, the engaging pin 140K of the retainer 41K is guided by the guide part 423*a*K of the engaging hole 423K so that the retainer 41K is moved toward the developing device 19K. As a result, the heat receiving part 32K held by the retainer 41K is moved toward the developing device 19K. As the retainer 41K is further moved to the back side of the image forming apparatus 100, the engaging pin 140K of the retainer 41K is guided by the guide part 423*a*K so that the heat receiving part 32K contacts the lateral surface of the developing device 19K as illustrated in FIG. 21. When the retainer 41K is further moved to the back side of the image forming apparatus 100, the heat receiving part 32K presses the developing device 19K while sliding past the lateral surface of the developing device 19K. At this time, in a case in which the first and second engaged parts 191K and 192K of the developing device 19K do not contact the first and second engaging parts 161K and 162K of the contact/separation mechanism 40K, respectively, a reactive force from the developing device 19K is transmitted to the supporter 42K from the heat receiving part 32K via the engaging pin 140K of the retainer 41K. As a result, the supporter 42K is pressed toward the direction separating from the developing device 19K. Because the supporter 42K is movably fixed to the fixed member 50K in the direction parallel to the direction of the pressing force of the coil spring 142K, the supporter 42K receives the reactive force from the developing device 19K and is moved in the direction separating from the developing device 19K as indicated by an arrow in FIG. 23. As a result, the first and second engaged parts 191K and 192K of the developing device 19K contact and engage with the first and second engaging parts 161K and 162K of the contact/separation mechanism 40K, respectively. When the retainer 41K is further moved toward the back side of the image forming apparatus 100, the supporter 42K is not moved to the direction separating from the developing device 19K even when receiving the reactive force from the developing device 19K. Accordingly, the coil springs 142K are compressed and the heat receiving part 32K is pressed against the lateral surface of the developing device 19K by the coil springs 142K. At this time, the retainer 41K receives a reaction of a force applied to the coil springs 142K from the heat receiving part 32K, and the reaction thus received by the retainer 41K is further received by the supporter 42K via the engaging pins 140K. In other words, both the retainer 41K and the supporter 42K serve as means for receiving the reaction of the force applied to the coil spring 142K. Because the first and second engaging parts 161K and 162K of the supporter 42K contact the first and second engaged parts 191K and 192K of the developing device 19K, respectively, the reaction received by the supporter 42K acts on the first and second engaged parts 191K and 192K of the developing device 19K. Specifically, the first and second engaging parts 161K and 162K engage with the first and second engaged parts 191K and 192K, respectively, so that the contact/separation mechanism 40K is fixed to the developing device 19K, thereby integrating the developing device 19K with the contact/separation mechanism 40K within the image forming unit 11K. Accordingly, the pressing force of the heat receiving part 32K does not act on the developing device 19K as an external force but acts within the developing device 19K as an internal force. As a result, the pressing force of the heat receiving part 32K transmitted to the front and back positioning plates 111K and 112K and so forth via the developing device 19K can be reduced. Further, deformation of the front and back positioning plates 111K and 112K and so forth can be prevented, thereby preventing a variation in the developing gap, and thus providing higher-quality images over time. Thereafter, when the engaging pin 140K of the retainer 41K is guided to the locking part 423*b*K of the engaging hole 423K, the heat receiving part 32K can press the developing device 19K with a predetermined force.

As described above with respect to FIG. 18, according to illustrative embodiments the guide part 423*a*K of the engaging hole 423K is slanted 45° relative to the longitudinal direction of the supporter 42K. Alternatively, the guide part 423*a*K of the engaging hole 423K may be slanted at an angle smaller than 45° to reduce a force to press the retainer 41K when the retainer 41K is moved from the front side to the back side of the image forming apparatus 100. By contrast, the guide part 423*a*K of the engaging hole 423K may be slanted at an angle greater than 45° to reduce an area where the heat conductive sheet 130K and the lateral surface of the developing device 19K slide past each other (hereinafter referred to as a sliding surface) when the engaging pin 140K of the retainer 41K is guided to the guide part 423*a*K of the engaging hole 423K to cause the heat receiving part 32K to contact or separate from the developing device 19K. Accordingly, the heat conductive sheet 130K is further prevented from being damaged.

Figure 24:
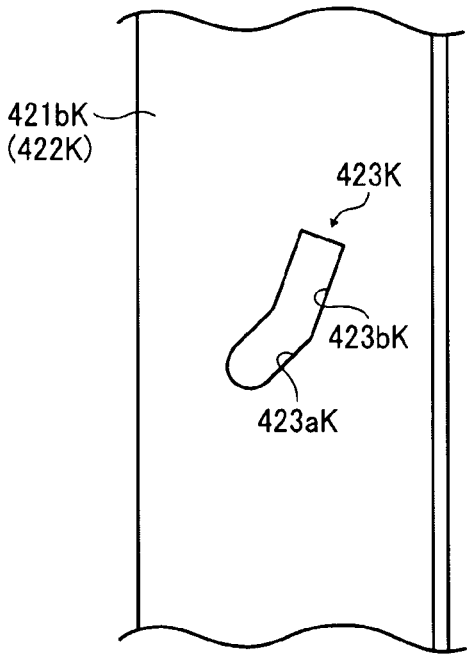
FIG. 24 is a schematic view illustrating another example of the engaging hole.

Further alternatively, as illustrated in FIG. 24, the locking part 423*b*K of the engaging hole 423K may be angled further to the developing device toward the back side of the image forming apparatus 100. Accordingly, the sliding surface can be reduced, thereby safeguarding the heat conductive sheet 130K from damage. However, in such a case, the engaging pin 140K of the retainer 41K is moved from a leading edge of the locking part 423*b*K to the guide part 423*a*K due to the reaction from the developing device 19K. Consequently, the heat receiving part 32K may not be pressed against the developing device 19K with adequate force. To prevent such a problem, in a case in which the engaging hole 423K is formed as illustrated in FIG. 24, it is necessary to provide a lock mechanism for preventing the retainer 41K from moving in the direction of attachment/detachment of the image forming unit 11K in order to prevent the engaging pin 140K of the retainer 41K from moving away from the leading edge of the locking part 423*b*K.

Figure 25:
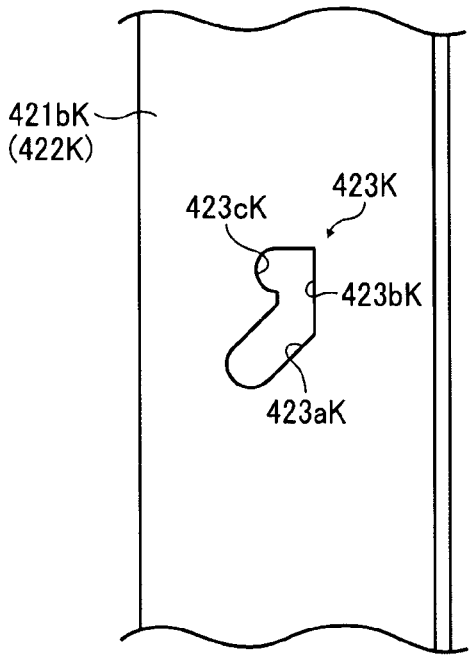
FIG. 25 is a schematic view illustrating yet another example of the engaging hole.

Yet further alternatively, a notch 423*c*K for stopping the engaging pin 140K at the locking part 423*b*K may be provided as illustrated in FIG. 25. Accordingly, the engaging pin 140K is moved in the direction separating from the developing device 19K when the engaging pin 140K is moved to the leading edge of the locking part 423*b*K, thereby reducing the pressing force of the heat receiving part 32K applied to the developing device 19K. As a result, when the engaging pin 140K reaches the leading edge of the locking part 423*b*K, a user can feel a click and easily recognize that the engaging pin 140K of the retainer 41K contacts the leading edge of the locking part 423*b*K while the user moves the retainer 41K to cause the heat receiving part 32K to contact or separate from the developing device 19K.

Because it is detachably attachable to the image forming apparatus 100, the image forming unit 11K is attached to the image forming apparatus 100 with a certain amount of tolerance or play. Consequently, the image forming unit 11K may be attached somewhat askew to the image forming apparatus 100. In such a case, the first engaged part 191K may get stuck to the first engaging part 161K, or the second engaged part 192K may get stuck to the second engaging part 162K, and consequently, the developing device 19K may not be smoothly attached to the image forming apparatus 100. To solve such a problem, according to illustrative embodiments, the supporter 42K is swingably fixed to the fixed member 50K in the direction parallel to the direction of the pressing force of the coil spring 142K. Accordingly, even when the image forming unit 11K is attached askew to the image forming apparatus 100 and one or the other of the first and second engaged parts 191K and 192K get stuck to the first and second engaging parts 161K and 162K, respectively, the supporter 42K swings and is positioned in parallel to the image forming unit 11K. As a result, the first and second engaged parts 191K and 192K of the developing device 19K do not get stuck to the first and second engaging parts 161K and 162K, so that the developing device 19K can be smoothly and reliably attached to the image forming apparatus 100.

Although being fixed to the fixed member 50K at the two positions described above according to illustrative embodiments, alternatively, the supporter 42K may be fixed to the fixed member 50K at any number of positions. However, when fixed to the fixed member 50K at an increased number of positions, the supporter 42K may be fixed to the fixed member 50K too tightly and cannot swing smoothly. Therefore, it is recommended to fix the supporter 42K to the fixed member 50K at two or three positions. Further alternatively, means to improve smoothness between the mounting part 421*d*K of the supporter 42K and the shoulder screw 150K, and the fixed base 51K of the fixed member 50K and the mounting part 421*d*K of the supporter 42K, such as a nylon washer or an application of grease, may be provided therebetween. Accordingly, even when the image forming unit 11K is attached askew to the image forming apparatus 100 and one or the other of the first and second engaged parts 191K and 192K get stuck to the first and second engaging parts 161K and 162K, respectively, the supporter 42K swings smoothly so that the developing device 19K can be more easily attached to the image forming apparatus 100.

According to illustrative embodiments, the retainer 41K is supported by the supporter 42K only using the engaging pins 140K provided at the center of the retainer 41K in the longitudinal direction thereof. Further, as illustrated in FIG. 21, the retainer 41K is supported by the supporter 42K such that a space is formed between the opposing part 41*a*K of the retainer 41K and the back face 421*a*K of the supporter 42K. Accordingly, the retainer 41K is supported swingably around the engaging pins 140K. As a result, when the heat receiving part 32K is pressed against the lateral surface of the developing device 19K of the image forming unit 11K attached askew to the image forming apparatus 100, the retainer 41K swings around the engaging pin 140K so that the heat receiving part 32K can be pressed against the developing device 19K parallel to the lateral surface of the developing device 19K.

Therefore, the heat receiving part 32K can be evenly pressed against the developing device 19K, thereby evenly cooling the developing device 19K.

The retainer 41K may be formed of a material having a heat conductivity lower than that of the material used in the heat receiving part 32K. As a result, a temperature increase in the retainer 41K can be suppressed, thereby reducing an amount of heat transmitted from the retainer 41K to the heat receiving part 32K. As described above, the heat receiving part 32K is formed mainly of copper having a heat conductivity of about 400 [W/mK] or aluminum having a heat conductivity of about 200 [W/mK]. Therefore, the retainer 41K is preferably formed of, for example, a resin such as POM having a heat conductivity of about 0.2 [W/mK], which is lower than the heat conductivity of copper and aluminum.

Figure 26:
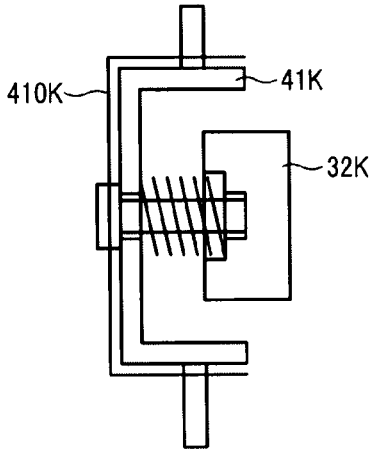
FIG. 26 is a schematic view illustrating a configuration in which a sheet having a heat conductivity lower than that of the heat receiving part is attached to external surfaces of the retainer.
Figure 27:
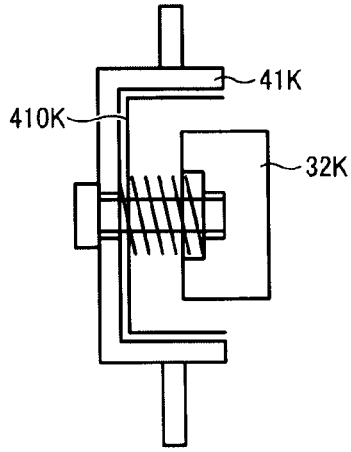
FIG. 27 is a schematic view illustrating a configuration in which a sheet having a heat conductivity lower than that of the heat receiving part is attached to internal surfaces of the retainer.

Alternatively, the retainer 41K may be partially formed of a material having a heat conductivity lower than that of the material used in the heat receiving part 32K. For example, a sheet 410K formed of a material having a heat conductivity lower than that of the material used in the heat receiving part 32K may be attached to external surfaces of the retainer 41K as illustrated in FIG. 26, or to internal surfaces of the retainer 41K as illustrated in FIG. 27. Further, a material having a heat conductivity lower than that of the material used in the heat receiving part 32K may be applied to the external or internal surfaces of the retainer 41K. Accordingly, reinforcement of the retainer 41K can be attained by increasing a strength of the main material included in the retainer 41K. Additionally, a material having a heat conductivity lower than that of the material used in the heat receiving part 32K may be applied to the external or internal surfaces of the retainer 41K after installation of the contact/separation mechanism 40K in the image forming apparatus 100.

Further, it is preferable that the members contacting the heat receiving part 32K, such as the shoulder screws 141K and the coil springs 142K, be formed of a material having a heat conductivity lower than that of the material used in the heat receiving part 32K. Accordingly, heat transmission due to heat conduction from the shoulder screws 141K or the coil springs 142K to the heat receiving part 32K can be reduced. The screw holes 32*d*K of the heat receiving part 32K and the bottom portions 32*e*K of the round notches 32*c*K may also be formed of a material having a heat conductivity lower than that of the material used in the heat receiving part 32K. As a result, heat transmission due to heat conduction from the shoulder screws 141K or the coil springs 142K to the heat receiving part 32K can also be reduced.

The supporter 42K holds some heat due to heat conduction from the image forming apparatus 100 itself via the fixed member 50K. Consequently, heat is transmitted to the retainer 41K from the supporter 42K via the engaging pins 140K when the engaging pins 140K are formed of a material having a high heat conductivity. Therefore, it is preferable that the engaging pins 140K of the retainer 41K be formed of a material having a heat conductivity lower than that of the material used in the heat receiving part 32K. Accordingly, heat transmission from the supporter 42K to the retainer 41K via the engaging pins 140K can be prevented, thereby preventing a temperature increase of the retainer 41K. As a result, an amount of heat transmitted from the retainer 41K to the heat receiving part 32K can be reduced, so that the heat receiving part 32K can more efficiently cool the developing device 19K.

As described above, according to illustrative embodiments, the retainer 41K is swingably supported by the supporter 42K with the engaging pins 140K acting as a pivot. Consequently, the ends of the retainer 41K in the longitudinal direction thereof may contact the supporter 42K due to vibration applied to the image forming apparatus 100 while the image forming unit 11K is detached from the image forming apparatus 100. When the ends of the retainer 41K in the longitudinal direction thereof contact the supporter 42K, a temperature of the retainer 41K may be increased by heat transmitted from the supporter 42K via the ends of the retainer 41K contacting the supporter 42K. Consequently, the heat receiving part 32K may not efficiently cool the developing device 19K.

Figure 28:
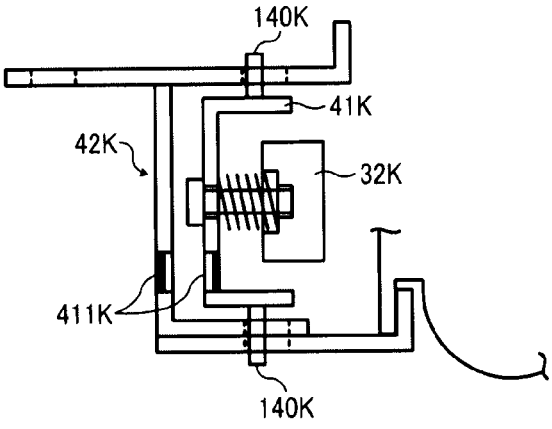
FIG. 28 is a schematic view illustrating a configuration in which a magnet is provided to the supporter and the retainer.

To solve the above-described problem, as shown in FIG. 28 magnets 411K are provided at each of both ends of the supporter 42K in the longitudinal direction thereof and both ends of the retainer 41K in the longitudinal direction thereof to prevent the ends of the retainer 41K from contacting the ends of the supporter 42K, respectively, by taking advantage of a repulsive force supplied by the magnets 411K of the same polarity. Further, a magnetic force between the supporter 42K and the retainer 41K is balanced using a force of attraction of the magnets 411K to prevent the ends of the retainer 41K in the longitudinal direction thereof from contacting the supporter 42K. However, in a case of using attraction of the magnets 411K, the ends of the retainer 41K in the longitudinal direction thereof contact the supporter 42K when the magnetic force between the supporter 42K and the retainer 41K is unbalanced. Therefore, it is more preferable to use the repulsive force of the magnets 411K than to use the attraction of the magnets 411K to prevent the ends of the retainer 41K from contacting the ends of the supporter 42K.

Figure 29:
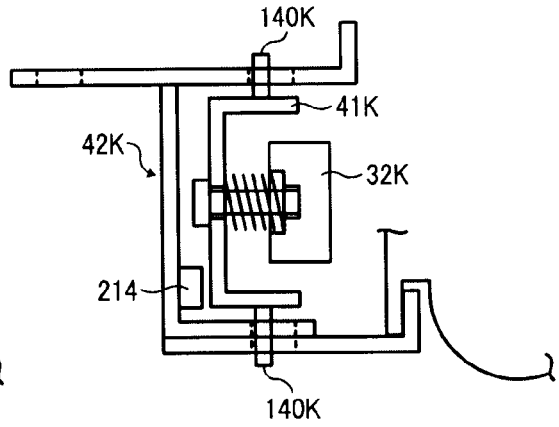
FIG. 29 is a schematic view illustrating a configuration in which a spacer is provided to the supporter.

Alternatively, as illustrated in FIG. 29, a spacer 214 formed of a material having a heat conductivity lower than that of the material used in the heat receiving part 32K may be provided at both ends of the supporter 42K in the longitudinal direction thereof. As a result, the ends of the retainer 41 contact the spacers 214, thereby preventing a temperature increase of the retainer 41K. Although the spacers 214 are provided at the ends of the supporter 42K in FIG. 29, alternatively, the spacers 214 may be provided to the ends of the retainer 41K.

A description is now given of a contact/separation mechanism according to a second illustrative embodiment.

Figure 30:
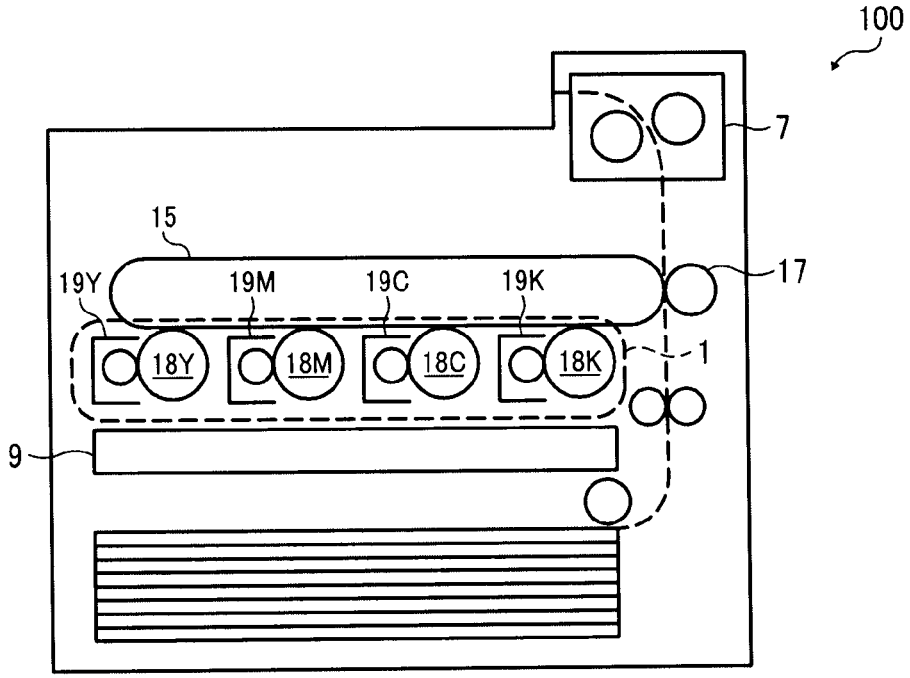
FIG. 30 is a schematic view illustrating another example of the configuration of the image forming apparatus according to illustrative embodiments.

In the second illustrative embodiment, the heat receiving part 32K is pressed against the bottom surface of the developing device 19K. FIG. 30 illustrates another example of a configuration of the image forming apparatus 100 in which the irradiating device 9 is provided below the image forming part 1 and there is a space below the developing devices 19Y, 19M, 19C, and 19K. In a case of the image forming apparatus 100 illustrated in FIG. 30, it is preferable that the heat receiving part 32K be pressed against the bottom surface of the developing device 19K to efficiently cool the developing device 19K. A temperature at the bottom surface of the developing device 19K is increased the most due to frictional heat generated by friction between the developer agitators and the developer, and friction within the developer. Therefore, the heat receiving part 32K is pressed against the bottom surface of the developing device 19K to more preferentially cool the bottom surface of the developing device 19K, thereby efficiently cooling the developing device 19K.

Figure 31:
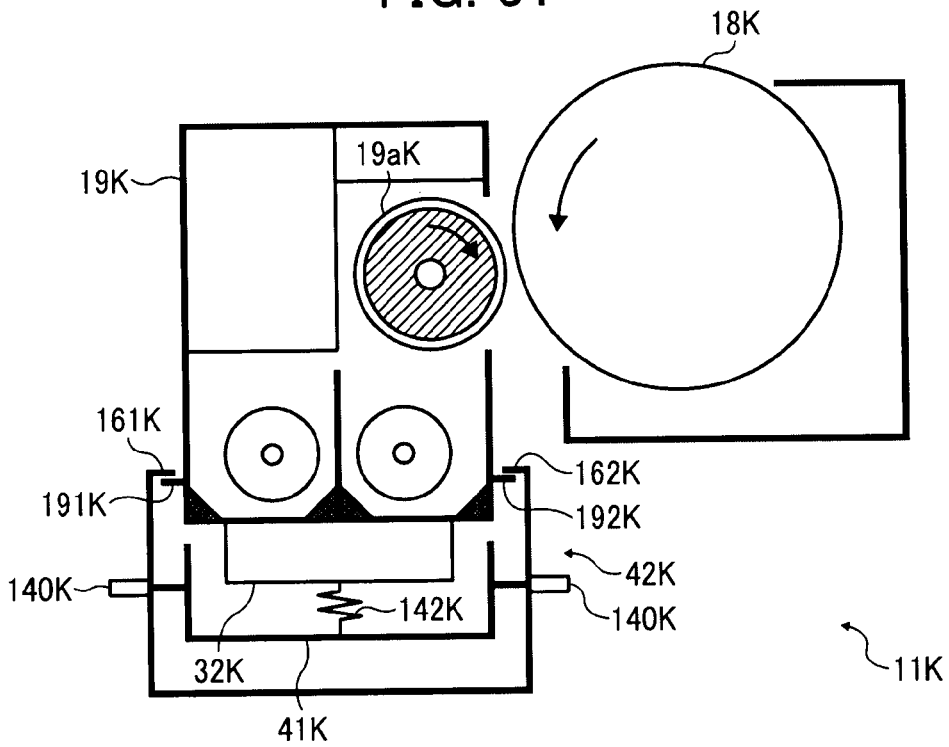
FIG. 31 is a schematic view illustrating a configuration around the image forming unit for a color of black according to a second illustrative embodiment in which the heat receiving part is pressed against a bottom surface of the developing device.
Figure 32:
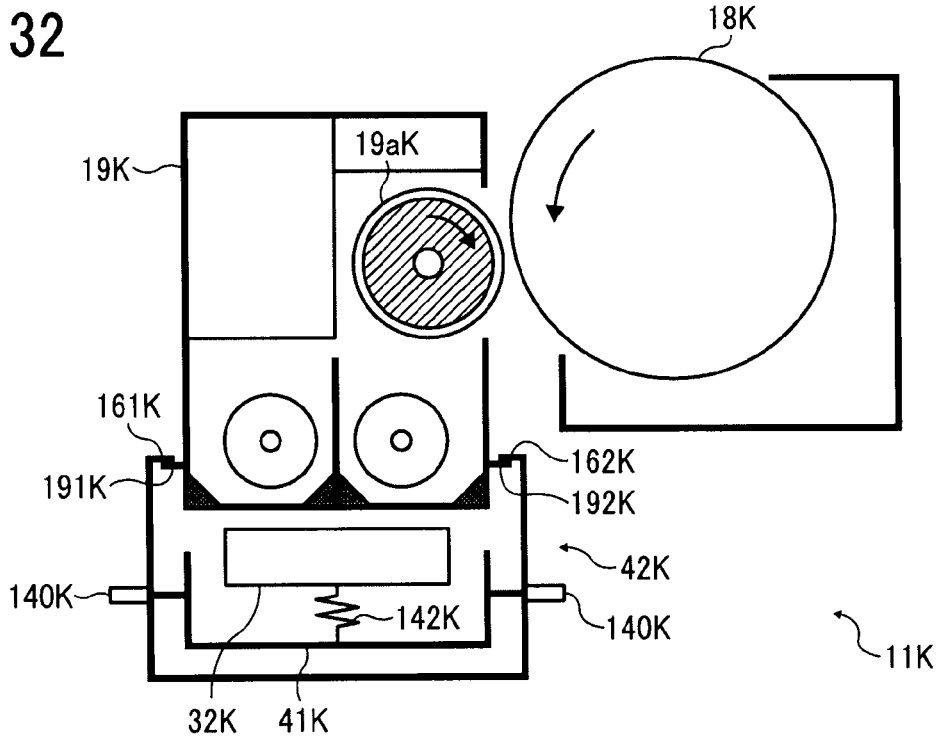
FIG. 32 is a schematic view illustrating a state in which the heat receiving part is separated from the bottom surface of the developing device.

FIG. 31 is a schematic view illustrating a state in which the heat receiving part 32K is pressed against the bottom surface of the developing device 19K. FIG. 32 is a schematic view illustrating a state in which the heat receiving part 32K is separated from the bottom surface of the developing device 19K.

The contact/separation mechanism 40K of the heat receiving part 32K according to the second illustrative embodiment illustrated in FIGS. 31 and 32 has the same configuration as that of the contact/separation mechanism 40K according to the first illustrative embodiment. Specifically, in the contact/separation mechanism 40K according to the second illustrative embodiment, the heat receiving part 32K is pressed against the developing device 19K by the coil spring 142K while being held by the retainer 41K. The engaging pin 140K provided at the center of the retainer 41 in the longitudinal direction thereof engages with the engaging hole 423K of the supporter 42K so that the supporter 42K supports the retainer 41K. The engaging hole 423K has the guide part 423*a*K and the locking part 423*b*K as illustrated in FIG. 18.

The first engaged part 191K is provided on a left lateral surface of the developing device 19K in FIG. 31, and the second engaged part 192K is provided on a right lateral surface, that is, a photoconductor 18K-side surface, of the developing device 19K in FIG. 31. When the heat receiving part 32K is pressed against the bottom surface of the developing device 19K, the first engaged part 191K contacts the first engaging part 161K provided at a left edge of the supporter 42K, and the second engaged part 192K contacts the second engaging part 162K provided at a right edge of the supporter 42K. Accordingly, a reaction of the pressing force of the coil spring 142K that presses the heat receiving part 32K can act on the first and second engaged part 191K and 192K of the developing device 19K. As a result, the force applied to the bottom surface of the developing device 19K from the heat receiving part 32K turns in an internal force generated inside the developing device 19K, and the pressing force of the heat receiving part 32K transmitted to the front and back positioning plates 111K and 112K, not shown in FIG. 31, and so forth via the developing device 19K is reduced, thereby preventing deformation of the front and back positioning plates 111K and 112K. Therefore, a variation in the developing gap can be prevented.

When being drawn to the front side of the image forming apparatus 100, the retainer 41K is moved downward so that the heat receiving part 32K held by the retainer 41K is separated from the bottom surface of the developing device 19K as illustrated in FIG. 32. Accordingly, the first and second engaging parts 161K and 162K are released from the first and second engaged parts 191K and 192K, respectively, so that the first and second engaging parts 161K and 162K and the first and second engaged parts 191K and 192K can be moved relative to each other, respectively, in the direction of attachment/detachment of the developing device 19K. As a result, because neither the force applied from the heat receiving part 32K nor the reaction of the force from the first and second engaging parts 161K and 162K act on the developing device 19K when the image forming unit 11K is drawn from the image forming apparatus 100, the image forming unit 11K can be easily detached from the image forming apparatus 100.

Figure 33:
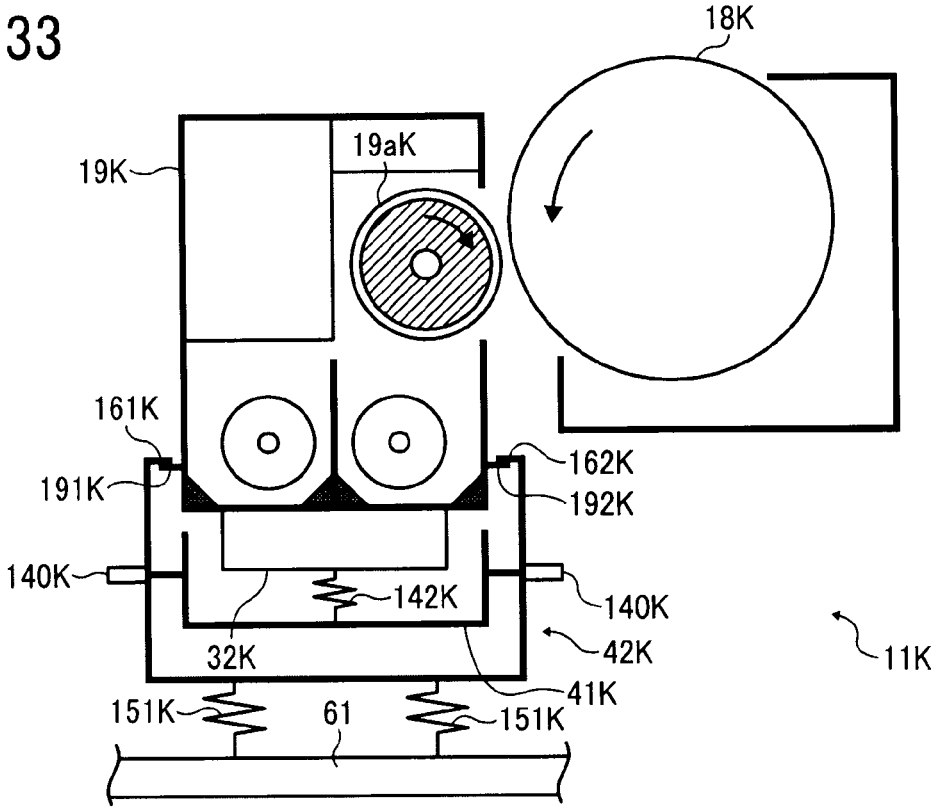
FIG. 33 is a schematic view illustrating a configuration in which the supporter is fixed to a partition plate with elastic members.
Figure 34:
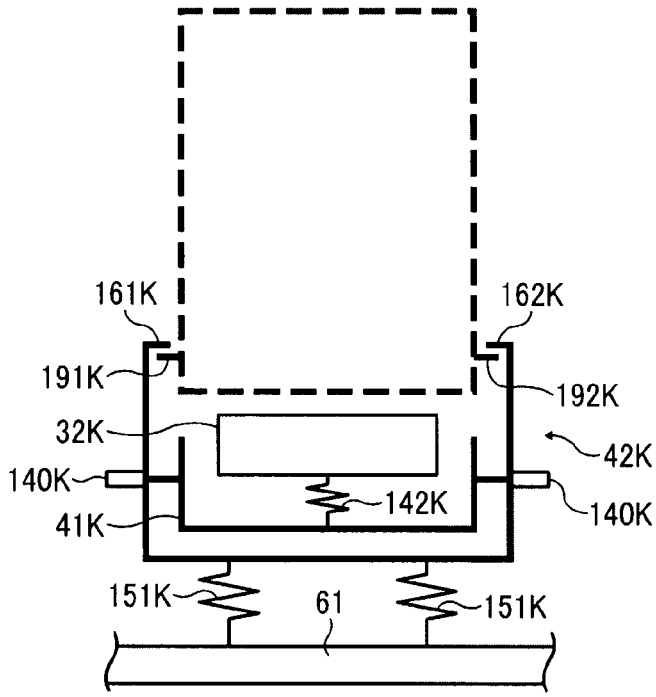
FIG. 34 is a schematic view illustrating a position of the supporter when the image forming unit is detached from the image forming apparatus.

Further, the supporter 42K may be fixed to the partition plate 61 via elastic members 151K as illustrated in FIG. 33. Accordingly, when the image forming unit 11K is attached askew to the image forming apparatus 100 and the first and second engaged parts 191K and 192K get stuck to the first and second engaging parts 161K and 162K, respectively, the elastic members 151K are elastically deformed so that the supporter 42K can be positioned in parallel to the image forming unit 11K. As a result, the first and second engaged parts 191K and 192K do not get stuck to the first and second engaging parts 161K and 162K when the image forming unit 11K is attached to the image forming apparatus 100. In addition, the elastic members 151K have a biasing force such that the first and second engaging parts 161K and 162K are positioned above the first and second engaged parts 191K and 192K even in a case in which a position of the supporter 42K is lowered by it own weight when the image forming unit 11K is detached from the image forming apparatus 100 as illustrated in FIG. 34.

It is to be noted that the biasing force of the elastic members 151K is weaker than the pressing force of the coil spring 142K that presses the heat receiving part 32K against the developing device 19K. Accordingly, when the retainer 41K is moved to the back side of the image forming apparatus 100 to cause the heat receiving part 32K to contact the developing device 19K, the supporter 42K is moved downward by a reactive force from the developing device 19K so that the first and second engaging parts 161K and 162K are caused to contact the first and second engaged parts 191K and 192K, respectively. As a result, the first and second engaging parts 161K and 162K can reliably receive the reaction of the pressing force from the heat receiving part 32K. Further, the heat receiving part 32K can be pressed with a predetermined force so that the heat receiving part 32K can closely contact the bottom surface of the developing device 19K.

Figure 35:
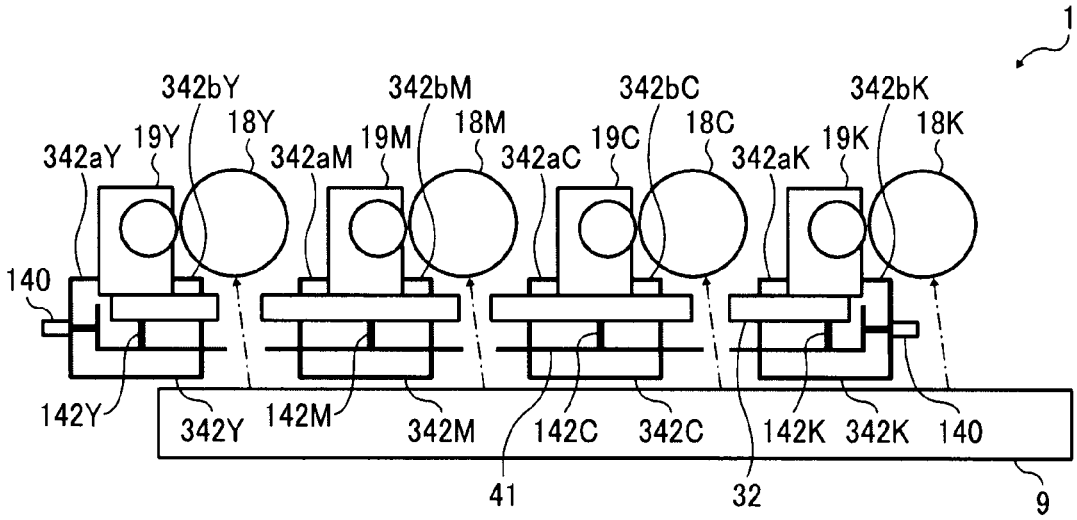
FIG. 35 is a schematic view illustrating a configuration in which developing devices are cooled by a single heat receiving part.

Alternatively, in a case of the image forming apparatus 100 in which the irradiating device 9 is provided below the image forming part 1 as illustrated in FIG. 30, the developing devices 19Y, 19M, 19C, and 19K may be cooled by a single heat receiving part 32 as illustrated in FIG. 35. The heat receiving part 32 has holes through which laser beams respectively directed to the photoconductors 18Y, 18M, and 18C pass. A contact/separation mechanism 40 includes a retainer 41 for holding the heat receiving part 32 and four engaging members 342Y, 342M, 342C, and 342K corresponding to the developing devices 19Y, 19M, 19C, and 19K, respectively. The engaging members 342Y, 342M, 342C, and 342K have first engaging parts 342*a*Y, 342*a*M, 342*a*C, and 342*a*K, and second engaging parts 342*b*Y, 342*b*M, 342*b*C, and 342*b*K, respectively. Each of the second engaging part 342*b*K of the engaging member 342K and the first engaging part 342*a*Y of the engaging member 342Y has an engaging hole like that illustrated in FIG. 18, and an engaging pin 140K provided to the retainer 41 engages with each of those holes. Similarly to the heat receiving part 32, the retainer 41 has holes through which laser beams respectively directed to the photoconductors 18Y, 18M, and 18C pass. The retainer 41 elastically holds the heat receiving part 32 via coil springs 142Y, 142M, 142C, and 142K provided opposite the bottom surfaces of the developing device 19Y, 19M, 19C, and 19K, respectively. Each of the first engaging part 342*a*K of the engaging member 342K, the first and second engaging parts 342*a*C and 342*b*C of the engaging member 342C, the first and second engaging parts 342*a*M and 342*b*M of the engaging member 342M, and the second engaging part 342*b*Y of the engaging member 342Y has a hole passing between the retainer 41 and the heat receiving part 32.

When the image forming unit 11K is replaced with new one, the retainer 41 is moved to the front side of the image forming apparatus 100, and then the image forming unit 11K is detached from the image forming apparatus 100 after the heat receiving part 32 is separated from the developing devices 19Y, 19M, 19C, and 19K. After replacement of the image forming unit 11K with new one, the retainer 41 is moved to the back side of the image forming apparatus 100 and the heat receiving part 32 is pressed against the developing devices 19Y, 19M, 19C, and 19K. Accordingly, the engaging members 342Y, 342M, 342C, and 342K engages with the developing devices 19Y, 19M, 19C, and 19K, respectively, so that the developing devices 19Y, 19M, 19C, and 19K receive a reactive force from the heat receiving part 32. As a result, a pressing force of the heat receiving part 32 transmitted to positioning plates, not shown, via the developing devices 19Y, 19M, 19C, and 19K is reduced, thereby preventing deformation of the positioning plates.

A description is now given of a contact/separation mechanism according to a third illustrative embodiment. In the third illustrative embodiment, the heat receiving part 32K is pressed against both the bottom and lateral surfaces of the developing device 19K. Because being cooled from the two surfaces thereof, the developing device 19K is more efficiently cooled.

Figure 36:
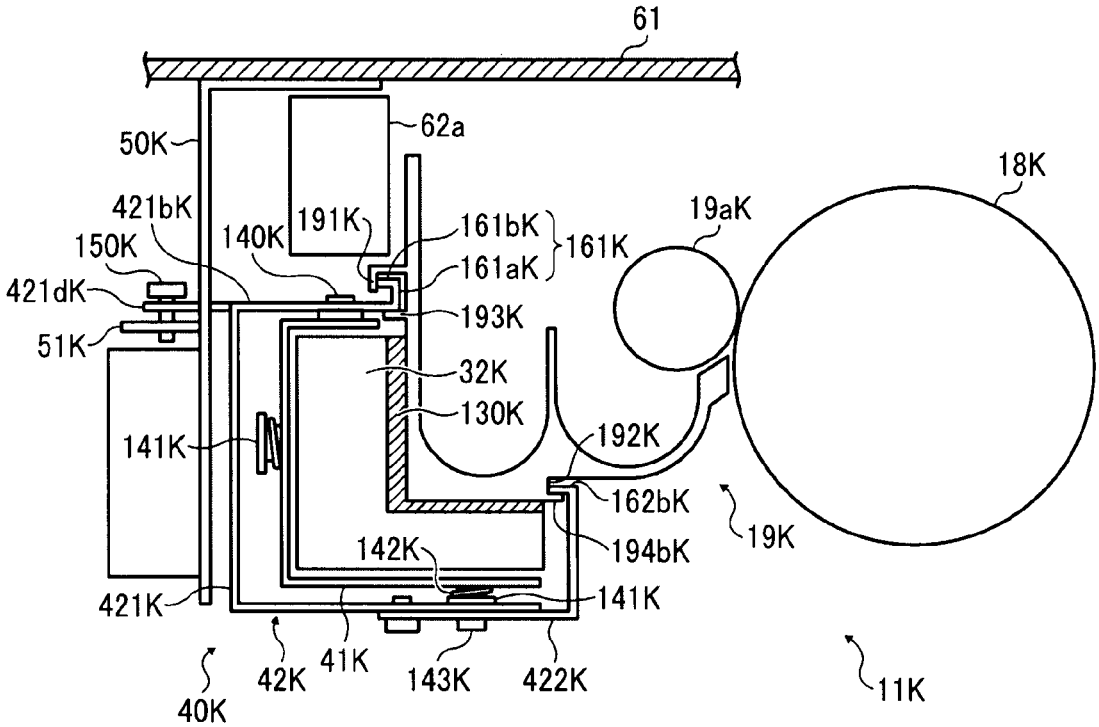
FIG. 36 is a cross-sectional view illustrating a configuration around the image forming unit for a color of black according to a third illustrative embodiment.
Figure 37:
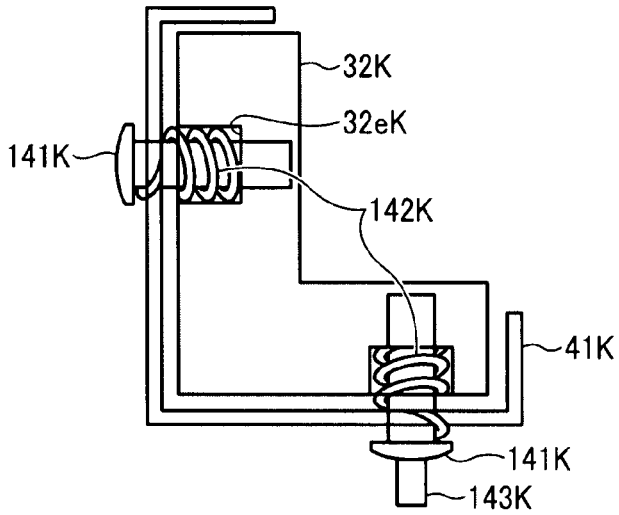
FIG. 37 is a cross-sectional view illustrating the retainer and the heat receiving part according to the third illustrative embodiment.

FIG. 36 is a cross-sectional view illustrating a configuration around the image forming unit 11K of the image forming apparatus 100 according to the third illustrative embodiment. FIG. 37 is a cross-sectional view illustrating the retainer 41K and the heat receiving part 32K according to the third illustrative embodiment.

In the third illustrative embodiment, the heat receiving part 32K has an L-shaped cross section. Further, the heat receiving part 32K is held by the retainer 41K while the bottom and lateral surfaces of the heat receiving part 32K are pressed by the coil springs 142K toward the developing device 19K. A head portion of the shoulder screw 141K fixed to each of the bottom and lateral surfaces of the heat receiving part 32K contacts the retainer 41K.

An engaging pin 143K is provided to the head portion of the shoulder screw 141K fixed to the center on the bottom surface of the heat receiving part 32K in the longitudinal direction thereof. In the manner similar to the configuration as described above, the engaging pin 140K is swaged into the center of the first part 41*c*K of the retainer 41K in the longitudinal direction thereof. The engaging pins 140K and 143K engages with the engaging holes 423K of the supporter 42K, respectively, so that the retainer 41K is supported by the supporter 42K. Each of the engaging holes 423K has the guide part 423*a*K and the locking part 423*b*K as illustrated in FIG. 18.

The supporter 42K is fixed to the fixed base 51K of the fixed member 50K with the shoulder screw 150K such that the supporter 42K can be moved relative to the fixed member 50K in both vertical and horizontal directions in FIG. 36.

Figure 38:
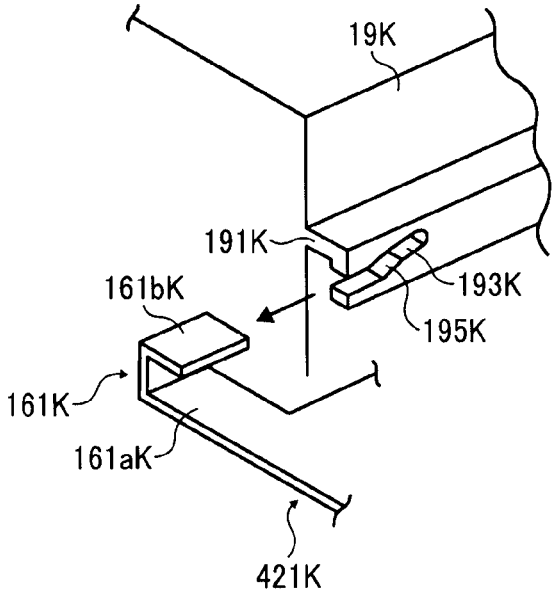
FIG. 38 is a schematic perspective view illustrating a configuration around a first engaging part according to the third illustrative embodiment.

FIG. 38 is a schematic perspective view illustrating a configuration around the first engaging part 161K according to the third illustrative embodiment.

In the third illustrative embodiment, the first engaging part 161K has a protrusion 161*a*K protruding toward the developing device 19K from a back portion of the leading edge of the support part 421*b*K of the first member 421K, and a hook 161*b*K.

The first engaged part 191K to be engaged with the first engaging part 161K is provided at the back edge of the lateral surface of the developing device 19K. As described above, the first engaged part 191K has a portion protruding from the lateral surface of the developing device 19K, that is, the protrusion, and a portion extending downward from a leading edge of the protrusion. The developing device 19K further includes a first pedestal surface 193K provided opposite the protrusion of the first engaged part 191K. A first guide surface 195K tilting downward from the first pedestal surface 193K is provided in the back of the first pedestal surface 193K.

Figure 39:
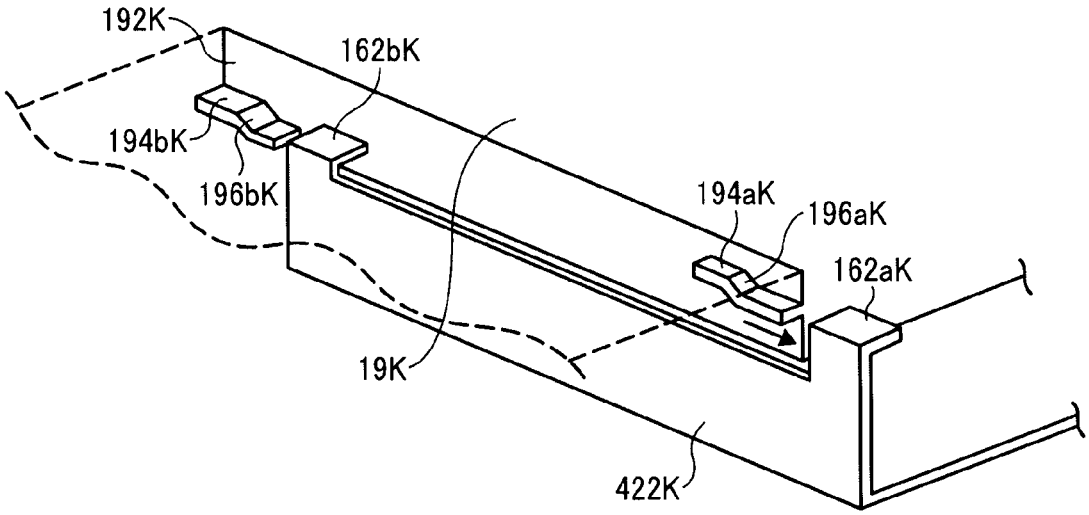
FIG. 39 is a schematic perspective view illustrating a configuration around a second engaging part according to the third illustrative embodiment.

FIG. 39 is a schematic perspective view illustrating a configuration around second engaging parts 162*a*K and 162*b*K according to the third illustrative embodiment. It is to be noted that, a part of the developing device 19K is not illustrated in FIG. 39 for the purpose of more clearly illustrating the configurations of the second engaging parts 162*a*K and 162*b*K and the second engaged part 192K.

Referring to FIG. 39, according to the third illustrative embodiment, the second engaging parts 162*a*K and 162*b*K protruding upward are provided at back and front edges of the second member 422K of the supporter 42K, respectively. A leading edge of each of the second engaging parts 162*a*K and 162*b*K is bent inward. Second pedestal surfaces 194*a*K and 194*b*K protruding toward the photoconductor 18K from the second engaged part 192K are provided at the back and front edges of the second engaged part 192K of the developing device 19K, respectively. Second guide surfaces 196*a*K and 196*b*K tilting downward from the second pedestal surfaces 194*a*K and 194*b*K, respectively, are provided in the back of the second pedestal surfaces 194*a*K and 194*b*K, respectively.

An amount of protrusion of the second engaging part 162*b*K provided in the front is smaller than that of the second engaging part 162*a*K provided in the back. The second pedestal surface 194*b*K provided in the front is positioned lower than the second pedestal surface 194*a*K provided in the back. Accordingly, the second engaging part 162*b*K provided in the front does not contact the second pedestal surface 194*a*K and the second guide surface 196*a*K provided in the back when the image forming unit 11K is attached to the image forming apparatus 100. Alternatively, a relation of the above-described height in the front and back may be reversed. Specifically, an amount of protrusion of the second engaging part 162*a*K provided in the back may be smaller than that of the second engaging part 162*b*K provided in the front, and the second pedestal surface 194*a*K provided in the back may be positioned lower than the second pedestal surface 194*b*K provided in the front. Further alternatively, in a case in which the image forming unit 11K can be inserted into the image forming apparatus 100 while tilting the developing device 19K in a vertical direction, a height of the second pedestal surfaces 194*b*K and 194*a*K in the front and back may be the same, and a height of the second engaging parts 162*b*K and 162*a*K in the front and back may be the same.

A description is now given of contact and separation of the heat receiving part 32K to and from the developing device 19K according to the third illustrative embodiment.

Figure 40:
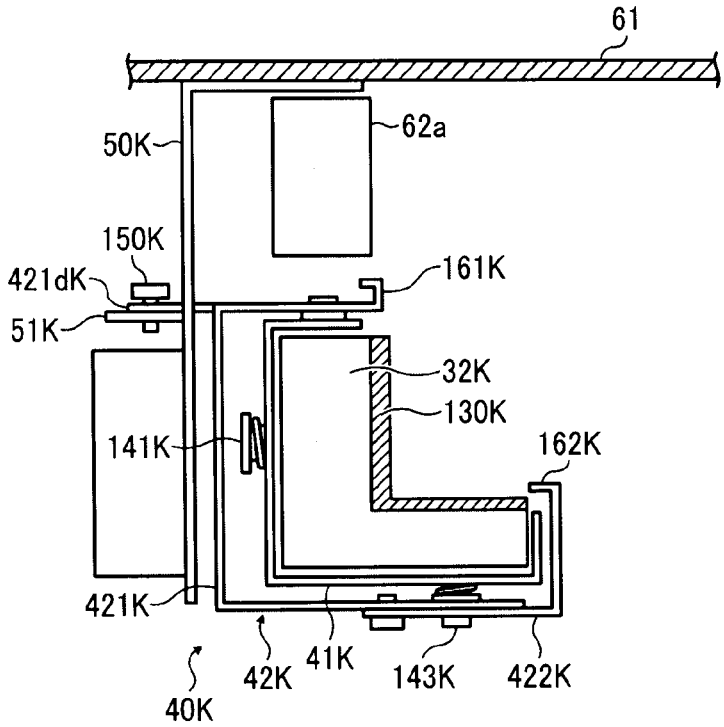
FIG. 40 is a cross-sectional view illustrating a state in which the image forming unit is detached from the image forming apparatus according to the third illustrative embodiment.
Figure 41:
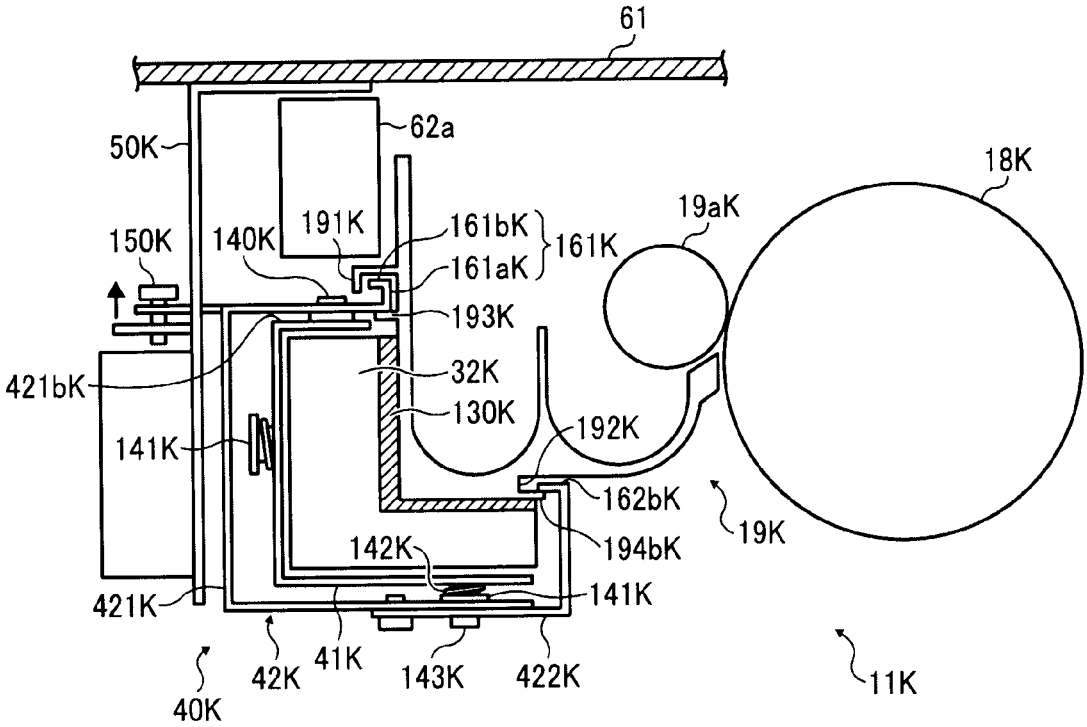
FIG. 41 is a cross-sectional view illustrating a state in which the heat receiving part is removed from the developing device according to the third illustrative embodiment.

When the image forming unit 11K is detached from the image forming apparatus 100, the mounting part 421*d*K of the supporter 42K is placed on the fixed base 51K of the fixed member 50K as illustrated in FIG. 40. When the image forming unit 11K is inserted into the image forming apparatus 100, the protrusion 161*a*K of the first engaging part 161K contacts the first guide surface 195K, and the second engaging parts 162*a*K and 162*b*K contact the second guide surfaces 196*a*K and 196*b*K, respectively. When the image forming unit 11K is further inserted into the image forming apparatus 100, the supporter 42K is guided to the second guide surfaces 196*a*K and 196*b*K and the first guide surface 195K, and is moved upward. At this time, the retainer 41K and the heat receiving part 32K are also moved upward together with the supporter 42K, and the heat receiving part 32K contacts the bottom surface of the developing device 19K. Further, when the image forming unit 11K is completely attached to the image forming apparatus 100, the second engaging parts 162*a*K and 162*b*K are placed on the second pedestal surfaces 194*a*K and 194*b*K, respectively, and the protrusion 161*a*K of the first engaging part 161K is placed on the first pedestal surface 193K as illustrated in FIG. 41. At this time, the coil spring 142K that presses the bottom surface of the heat receiving part 32K is compressed to press the heat receiving part 32K upward. Accordingly, the heat receiving part 32K is pressed against the bottom surface of the developing device 19K. Further, a reaction of the pressing force of the coil spring 142K that presses the bottom surface of the heat receiving part 32K acts on the head portion of the shoulder screw 141K fixed to the bottom surface of the heat receiving part 32K so that the shoulder screw 141K presses the supporter 42K downward. Accordingly, the reaction of the pressing force of the coil spring 142K further acts on the first pedestal surface 193K of the developing device 19K via the protrusion 161*a*K of the first engaging part 161K provided to the supporter 42K, and the second guide surfaces 196*a*K and 196*b*K of the developing device 19K via the second engaging parts 162*a*K and 162*b*K of the supporter 42K. As a result, the developing device 19K receives the reaction of the pressing force of the heat receiving part 32K that presses the developing device 19K upward. Therefore, the pressing force of the heat receiving part 32K can be turned in an internal force within the developing device 19K.

As illustrated in FIG. 41, after the image forming unit 11K is attached to the image forming apparatus 100, the lever, not shown, is operated to move the retainer 41K to the back side of the image forming apparatus 100 in the similar manner as described above. A reactive force from the lateral surface of the developing device 19K is transmitted from the heat receiving part 32K to the supporter 42K through the engaging pin 140K of the retainer 41K, and the supporter 42K is moved in the direction separating from the developing device 19K, that is, the left direction in FIG. 41. As a result, the first and second engaged parts 191K and 192K of the developing device 19K contact the first engaging part 161K and the second engaging parts 162*a*K and 162*b*K of the contact/separation mechanism 40K, and a reaction received by the supporter 42K acts on the first and second engaged parts 191K and 192K of the developing device 19K.

Thus, according to the third illustrative embodiment, the force applied from the heat receiving part 32K can be turned in an internal force within the developing device 19K, so that the pressing force of the heat receiving part 32K transmitted to the front and back positioning plates 111K and 112K through the developing device 19K can be reduced. As a result, deformation of the front and back positioning plates 111K and 112K and a variation in the developing gap can be prevented, thereby providing higher-quality images over time.

A description is now given of a forth illustrative embodiment.

Figure 42:
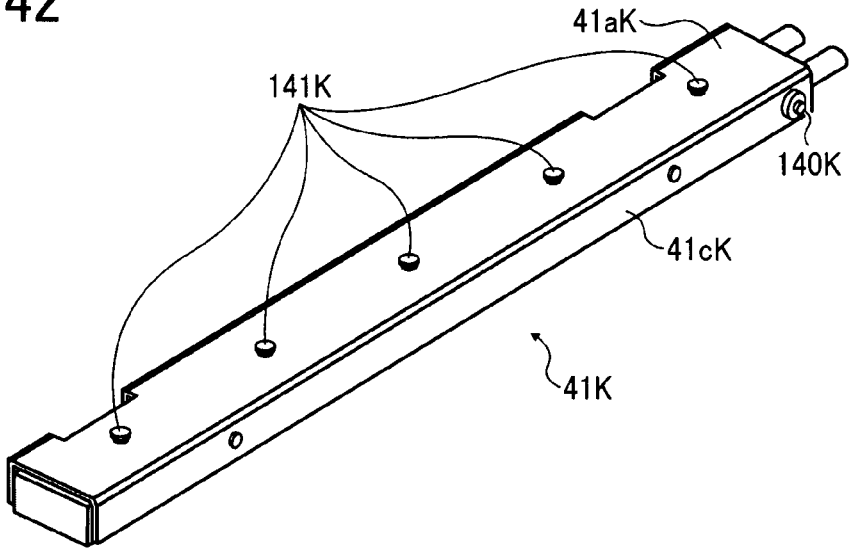
FIG. 42 is a perspective view illustrating the retainer according to a fourth illustrative embodiment.
Figure 43:
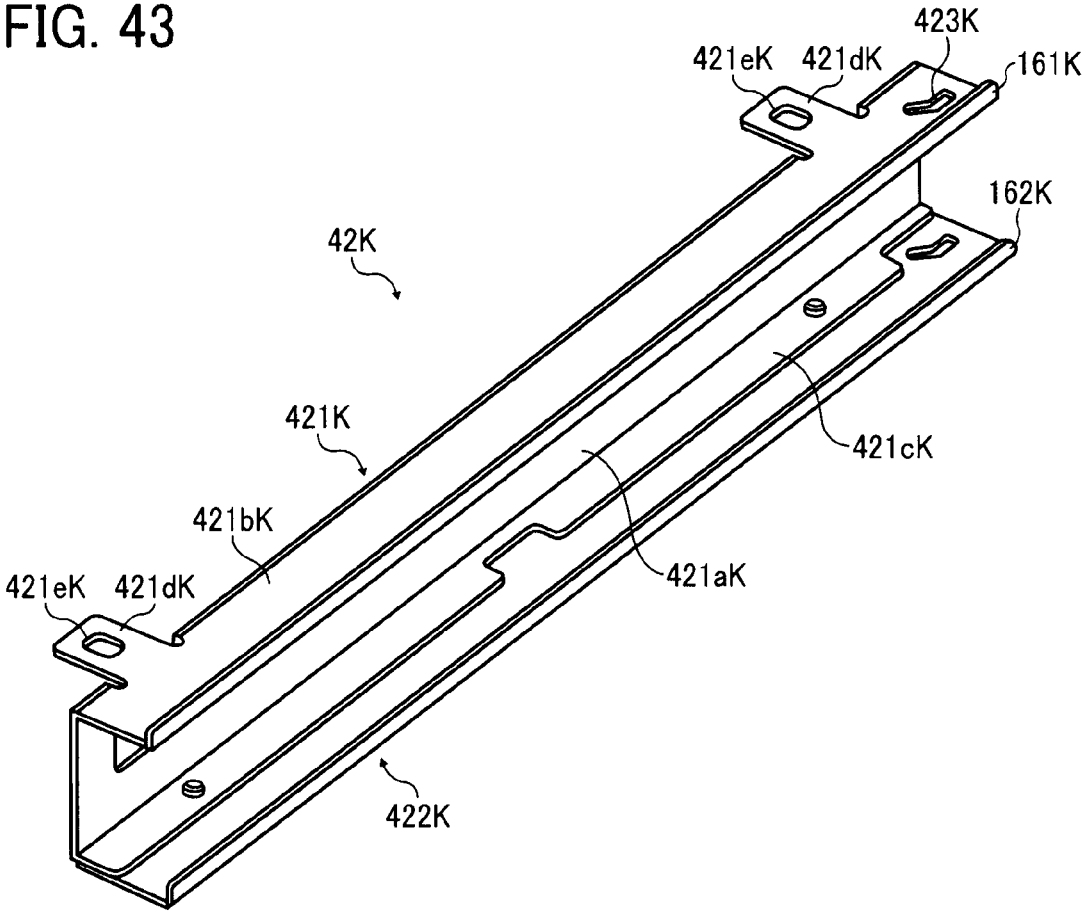
FIG. 43 is a perspective view illustrating the supporter according to the fourth illustrative embodiment.

In the forth illustrative embodiment, the engaging pin 140K is swaged into the back end of the retainer 41K as illustrated in FIG. 42, and the engaging hole 423K is provided at the back end of the supporter 42K as illustrated in FIG. 43, so that the engaging pin 140K engages with the engaging hole 423K. As a result, the retainer 41K is swingably supported by the supporter 42K with the back end of the retainer 41 acting as a pivot.

The above-described configuration according to the forth illustrative embodiment enables to limit friction between the contact surface of the heat receiving part 32K and the lateral surface of the developing device 19K to the back end of the heat receiving part 32K by pressing the heat receiving part 32K against the developing device 19K as follows. Specifically, the front end of the retainer 41K is approached to the supporter 42K so that the front side of the heat receiving part 32K is sufficiently separated from the lateral surface of the developing device 19K to move the retainer 41K to the back side of the image forming apparatus 100. Accordingly, only the back end of the heat receiving part 32K contacts the lateral surface of the developing device 19K. As a result, the sliding surface between the developing device 19K and the heat receiving part 32K is reduced, thereby improving durability. In particular, deterioration of the heat conductive sheet 130K can be reduced in a case in which the heat conductive sheet 130K is provided between the heat receiving part 32K and the developing device 19K. Because being softer than metal, the heat conductive sheet 130K is easily damaged when sliding past the developing device 19K or the heat receiving part 32K.

When the retainer 41K is moved to the back side of the image forming apparatus 100, a lock mechanism, not shown, provided at the front side of the retainer 41K is used to fix the retainer 41K to the developing device 19K. As a result, a reaction of the pressing force of the coil spring 142K acts on the developing device 19K via the lock mechanism at the front side of the retainer 41K. By contrast, at the back side of the retainer 41K, when the front end of the retainer 41K is fixed to the developing device 19K using the lock mechanism as described above, a reactive force from the developing device 19K is received by the supporter 42K via the engaging pin 140K. Then, the supporter 42K is moved to the direction separating from the developing device 19K so that the first and second engaging parts 161K and 162K of the supporter 42K engages with the developing device 19K. Accordingly, at the back side of the retainer 41K, a reaction of the pressing force of the coil spring 142K acts on the developing device 19K via the first and second engaging parts 161K and 162K of the supporter 42K. As a result, the contact/separation mechanism 40K is fixed to the developing device 19K, and the contact/separation mechanism 40K and the developing device 19K are integrated within the image forming apparatus 100 so that the pressing force of the heat receiving part 32K that presses the surface of the developing device 19K can be turned in an internal force within the developing device 19K. As a result, the pressing force of the heat receiving part 32K transmitted to the front and back positioning plates 111K and 112K through the developing device 19K can be reduced, thereby preventing deformation of the front and back positioning plates 111K and 112K.

Also in the forth illustrative embodiment, the retainer 41K is swingably supported by the supporter 42K with the engaging pin 140K acting as a pivot. Therefore, when the heat receiving part 32K is pressed against the lateral surface of the developing device 19K of the image forming unit 11K attached askew to the image forming apparatus 100, the retainer 41K is rotated around the engaging pin 140K so that the heat receiving part 32K is pressed against the lateral surface of the developing device 19K in parallel to each other. As a result, the heat receiving part 32K is evenly pressed against the developing device 19K so that the developing device 19K can be evenly cooled.

Figure 44:
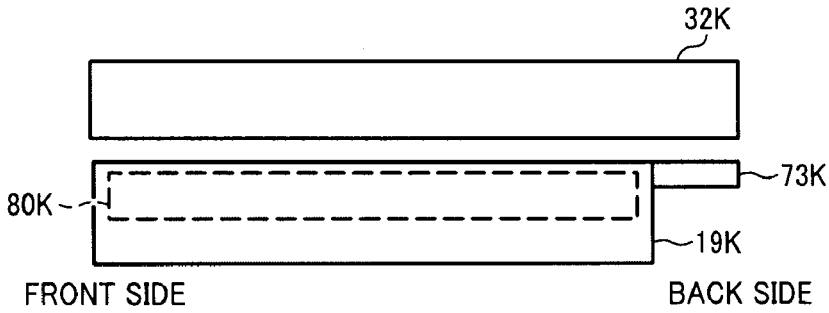
FIG. 44 is a schematic view illustrating a configuration in which a protrusion is provided to a back surface of the developing device.

Further, according to the fourth illustrative embodiment, a protrusion 73K protruding from a back surface of the developing device 19K and positioned in the back of a developer container 80K is provided as illustrated in FIG. 44. Therefore, when the developing device 19K is attached to the image forming apparatus 100, the back end of the heat receiving part 32K may be positioned closer to the back side of the image forming apparatus 100 than the developer container 80K of the developing device 19K. Accordingly, when the front side of the retainer 41K is approached to the supporter 42K to move the retainer 41K to the back side of the image forming apparatus 100 as described above, the back end of the heat receiving part 32K slides past the protrusion 73K. Because it is not necessary to cool the protrusion 73K, damages of the back end of the heat receiving part 32K due to friction with the protrusion 73K does not cause any problem. Therefore, damages caused by friction between the lateral surface of the developing device 19K and the contact surface of the heat receiving part 32K that faces the developer container 80K of the developing device 19K and is required to be cooled can be prevented. As a result, the contact surface of the heat receiving part 32K facing the developer container 80K and the lateral surface of the developing device 19K can reliably contact each other over time, thereby providing higher cooling performance over time. It is to be noted that the protrusion 73K may not be necessarily provided.

Figure 45A:
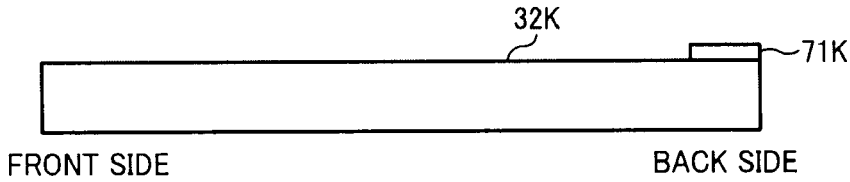
FIGS. 45A and 45B are schematic views respectively illustrating a configuration in which a protection layer is provided at a back end of the heat receiving part.
Figure 45B:
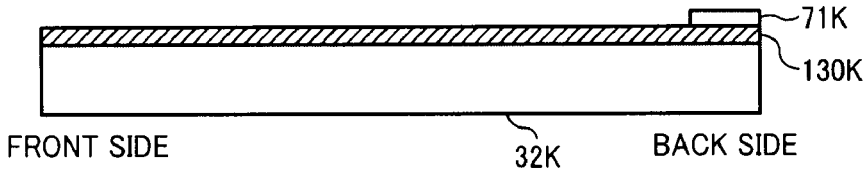

Alternatively, in the fourth illustrative embodiment, a protective layer 71K may be provided at the back end of the heat receiving part 32K as illustrated in FIGS. 45A and 45B. FIG. 45A is a view illustrating a configuration in which the heat conductive sheet 130K is not provided on the contact surface of the heat receiving part 32K. FIG. 45B is a view illustrating a configuration in which the heat conductive sheet 130K is provided on the contact surface of the heat receiving part 32K. When the front side of the retainer 41K is approached to the supporter 42K to move the retainer 41K to the back side of the image forming apparatus 100 as described above, the protective layer 71K slides past the lateral surface of the developing device 19K so that damages of the heat receiving part 32K or the heat conductive sheet 130K can be prevented. Further, the protective layer 71K may include a low friction member to improve sliding performance between the developing device 19K and the protective layer 71K, thereby improving durability of the developing device 19K and the protective layer 71K. It is to be noted that the protective layer 71K may be alternatively provided at the back end of the developing device 19K or both the developing device 19K and the heat receiving part 32K.

To simplify FIGS. 45A and 45B, the protective layer 71K is illustrated thicker than in actual. Actually, the protective layer 71K is a thin film, so that provision of the protective layer 71K does not affect the pressing force of the heat receiving part 32K that presses the developing device 19K.

In the above-described configuration, the positions of the developing device 19K and the photoconductor 18K are determined by the front and back positioning plates 111K and 112K, and the developing device 19K and the photoconductor 18K are integrally provided within the image forming unit 11K to be attached and detached to and from the image forming apparatus 100. Alternatively, the developing device 19K may be configured to be solely attached to and detached from the image forming apparatus 100. In such a case, when the developing device 19K is attached to the image forming apparatus 100, the position of the developing device 19K is determined by a positioning member provided within the image forming apparatus 100, and the gap between the photoconductor 18K and the developing roller 19*a*K is kept at a predetermined value. Thus, the pressing force of the heat receiving part 32K transmitted to the positioning member through the developing device 19K can be reduced even in the above-described configuration in which the developing device 19K is solely attached to and detached from the image forming apparatus 100 by applying the foregoing illustrative embodiments. As a result, deformation of the positioning member can be prevented, and the developing gap can be accurately kept constant.

A description is now given of a fifth illustrative embodiment in which the present invention is used in the belt cleaning unit 1000 to cool waste toner.

Figure 46:
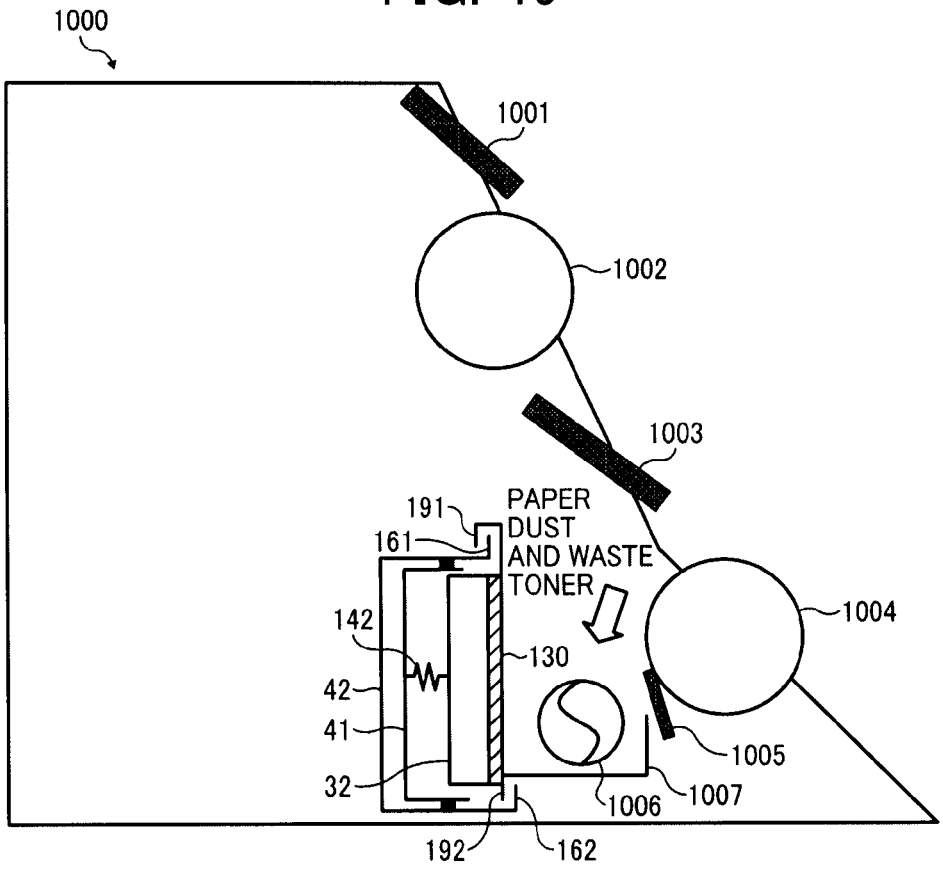
FIG. 46 is a schematic view illustrating a configuration according to a fifth illustrative embodiment in which a liquid cooling device is attached to a belt cleaning unit.

FIG. 46 is a schematic view illustrating a configuration in which a liquid cooling device is attached to the belt cleaning unit 1000 to cool the belt cleaning unit 1000.

The belt cleaning unit 1000 includes a paper dust removal brush 1004 to remove paper dust attached to the intermediate transfer belt 15 after secondary transfer, a flicker 1005 to scrape off the paper dust attached to the paper dust removal brush 1004, a cleaning blade 1003 to remove toner and so forth, a waste toner collection unit 1007 to collect the toner thus removed, a conveyance screw 1006 to convey the toner thus collected and so forth, an application brush 1002 to apply a lubricating agent to the intermediate transfer belt 15, and an application blade 1001 to spread the lubricating agent.

The toner and so forth removed from the intermediate transfer belt 15 by the paper dust removal brush 1004 and the cleaning blade 1003 is collected to the waste toner collection unit 1007, and then is conveyed by the conveyance screw 1006 to be combined with other waste toner within the image forming apparatus 100.

In order to prevent adhesion of the toner within the waste toner collection unit 1007 due to heat generated by the fixing device 7 and rotation of the conveyance screw 1006, the liquid cooling device 30 is attached to the waste toner collection unit 1007 in the belt cleaning unit 1000. The waste toner collection unit 1007 includes a first engaged part 191 and the second engaged part 192 to respectively engage with the first engaging part 161 and the second engaging part 162 provided to a contact/separation mechanism of a liquid cooling device in a manner similar to that of the foregoing illustrative embodiments. Accordingly, the reaction of a pressing force of coil spring 142 serving as pressing means provided to the contact/separation mechanism can act on the first and second engaged parts 191 and 192 of the waste toner collection unit 1007.

According to the fifth illustrative embodiment, the waste toner within the conveyance screw 1006 can be cooled while keeping a distance between the cleaning blade 1003 and the intermediate transfer belt 15 constant without causing shutdown of the operation of the conveyance screw 1006 and the intermediate transfer belt 15 due to adhesion of the toner. Thus, image blur caused by toner remaining on the intermediate transfer belt 15 without being removed by the cleaning blade 1003 due to the distance between the cleaning blade 1003 and the intermediate transfer belt 15 being larger than a predetermined value can be prevented. Conversely, damage to the cleaning blade 1003 and the intermediate transfer belt 15 due to the distance between the cleaning blade 1003 and the intermediate transfer belt 15 being smaller than the predetermined value can be prevented.

Figure 47:
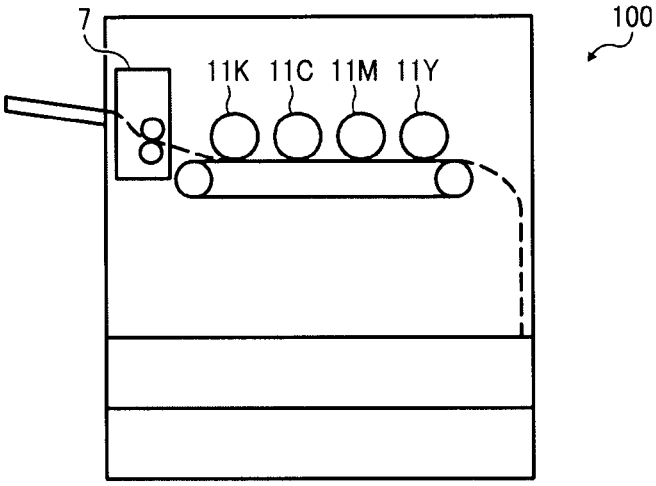
FIG. 47 is a schematic view illustrating a tandem type full-color image forming apparatus employing a direct transfer method.

The foregoing illustrative embodiments are applicable to image forming apparatuses other than the tandem type full-color image forming apparatus employing an intermediate transfer method. For example, the foregoing illustrative embodiments are applicable to a tandem type full-color image forming apparatus employing a direct transfer method illustrated in FIG. 47. As described above, the foregoing illustrative embodiments are applicable to the image forming apparatus 100 employing the two-component developing method in which development is performed by forming the developing gap between the photoconductor 18K and the developing roller 19*a*K. However, the foregoing illustrative embodiments are also applicable to image forming apparatuses employing a one-component developing method in which development is performed by contacting a developing roller to a photoconductor. In the image forming apparatuses employing the one-component developing method, contact pressure between the developing roller and the photoconductor is increased when the heat receiving part is pressed against the developing device. The foregoing illustrative embodiments can prevent the increase in the contact pressure between the developing roller and the photoconductor by turning the pressing force of the heat receiving part into an internal force within the developing device as described above.

According to the foregoing illustrative embodiments, when the heat receiving part 32K is pressed against the lateral surface of the developing device 19K, a reaction of the pressing force of the heat receiving part 32K applied to the coil spring 142K is caused to act on a predetermined portion of the developing device 19K. Accordingly, the pressing force applied to the lateral surface of the developing device 19K from the heat receiving part 32K is turned into an internal force within the developing device 19K, thereby reducing the pressing force of the heat receiving part 32K transmitted to the front and back positioning plates 111K and 112K through the developing device 19K. As a result, change in the developing gap between the photoconductor 18K and the developing roller 19*a*K can be prevented.

The contact/separation mechanism 40K includes the retainer 41K and the supporter 42K both serving as means for receiving reaction of the pressing force of the heat receiving part 32K. The supporter 42K includes the first and second engaging parts 161K and 162K respectively engaging with the first and second engaged parts 191K and 192K of the developing device 19K. When the supporter 42K receives reaction of the pressing force of the heat receiving part 32K, the first and second engaging parts 161K and 162K engages with the first and second engaged parts 191K and 192K, respectively, so that the contact/separation mechanism 40K is fixed to the developing device 19K. As a result, reaction of the pressing force of the heat receiving part 32K applied to the coil spring 142K is caused to act on the first and second engaged parts 191K and 192K of the developing device 19K.

When the heat receiving part 32K is separated from the developing device 19K, the first and second engaging parts 161K and 162K and the first and second engaged parts 191K and 192K are respectively moved relative to each other in the direction of attachment/detachment of the developing device 19K. As a result, the developing device 19K is easily detached from the image forming apparatus 100.

The contact/separation mechanism 40 includes the supporter 42K to support the retainer 41K such that the retainer 41K can contact or separate from the developing device 19K. Accordingly, the heat receiving part 32K can contact or separate from the developing device 19K by operating the retainer 41K.

The retainer 41K has the engaging pin 140K, and the supporter 42K has the engaging hole 423K engaging with the engaging pin 140K to guide the engaging pin 140K in the direction contacting and separating from the developing device 19K. Accordingly, the heat receiving part 32K can contact or separate from the developing device 19K by operating the retainer 41K. Further, the retainer 41K can be prevented from releasing from the supporter 42K.

The engaging pin 140K is formed of a material having a heat conductivity lower than the material used in the heat receiving part 32K so that transmission of heat of the supporter 42K to the retainer 41K through the engaging pin 140K can be prevented. Accordingly, an increase in a temperature of the retainer 41K can be prevented, thereby preventing an increase in a temperature of the heat receiving part 32K caused by heat transmitted from the retainer 41K. As a result, the developing device 19K can be reliably cooled.

The engaging pin 140K is provided at the center of the retainer 41K in the direction of attachment/detachment of the developing device 19K so that the retainer 41K is swingably supported with the engaging pin 140K acting as a pivot. Accordingly, even when the developing device 19K is attached askew to the image forming apparatus 100, the retainer 41K swings around the engaging pin 140K so that the retainer 41K can be positioned in parallel to the lateral surface of the developing device 19K. As a result, the heat receiving part 32K can be evenly pressed against the developing device 19K in the longitudinal direction of the developing device 19K even when the image forming unit 11K is attached askew to the image forming apparatus 100, thereby evenly cooling the developing device 19K in the longitudinal direction thereof.

The both ends on the back surface of the supporter 42K in the direction of attachment/detachment of the developing device 19K and the both ends on the surface of the retainer 41K facing the back surface of the supporter 42K in the direction of attachment/detachment of the developing device 19K magnetically repel and attract each other to prevent the ends of the retainer 41K in the longitudinal direction thereof from contacting the supporter 42K. Accordingly, transmission of heat from the supporter 42K to the retainer 41K can be prevented, thereby preventing an increase in a temperature of the retainer 41K. As a result, an increase in a temperature of the heat receiving part 32K caused by heat transmitted from the retainer 41K can be prevented, so that the developing device 19K can be reliably cooled.

The spacer 214 formed of a material having a heat conductivity lower than that of the material used in the heat receiving part 32K are provided at the both ends on the back surface of the supporter 42K in the direction of attachment/detachment of the developing device 19K, or at the both ends on the surface of the retainer 41K facing the back surface of the supporter 42K in the direction of attachment/detachment of the developing device 19K. Accordingly, the both ends of the retainer 41K in the longitudinal direction thereof contact the spacer 214, but do not contact the supporter 42K. Because the spacer 214 is formed of a material having a heat conductivity lower than that of the material used in the heat receiving part 32K as described above, transmission of heat from the spacer 214, that is, heat from the supporter 42K, to the retainer 41K can be prevented even when the retainer 41K contacts the spacer 214. As a result, an increase in a temperature of the retainer 41K can be prevented, so that an increase in a temperature of the heat receiving part 32K due to the heat transmitted from the retainer 41K can be prevented, thereby reliably cooling the developing device 19K.

The engaging pin 140K may be provided at the back end of the retainer 41K positioned opposite the opening to or from which the developing device 19K is attached or detached the image forming apparatus 100. Accordingly, the front side of the retainer 41K approaches the supporter 42K to move the retainer 41K to the back side of the image forming apparatus 100, so that only the back end on the contact surface of the heat receiving part 32K slides past the surface of the developing device 19K. As a result, the sliding surface between the developing device 19K and the heat receiving part 32K can be reduced, improving durability of the heat receiving part 32K.

In addition, the back end of the retainer 41K is positioned closer to the back side of the image forming apparatus 100 than the developer container 80K of the developing device 19K. Accordingly, the back end of the heat receiving part 32K does not face the developer container 80K, thereby preventing a portion of the heat receiving part 32K facing the developer container 80K from being damaged by sliding past the developing device 19K. As a result, the heat receiving part 32K facing the developer container 80K of the developing device 19K can reliably contact the lateral surface of the developing device 19K over time, so that the developing device 19K can be reliably cooled over time.

Further, the protective layer 71K to protect the contact surface of the heat receiving part 32K is provided at least one of the back end on the contact surface of the heat receiving part 32K and the back end of the lateral surface of the developing device 19K facing the heat receiving part 32K. Accordingly, the protective layer 71K slides past the lateral surface of the developing device 19K, so that damages of the heat receiving part 32K can be prevented.

The protective layer 71K is formed of a low-friction material to improve sliding performance of the protective layer 71K, thereby preventing damages on the contact surface of the heat receiving part 32K or the lateral surface of the developing device 19K which slides past the protective layer 71K.

The engaging hole 423K has the guide part 423*a*K for guiding the engaging pin 140K in the direction separating from the developing device 19K, and the locking part 423*b*K for locking the engaging pin 140K at a position closest to the developing device 19K when the heat receiving part 32K is pressed against the surface of the developing device 19K. Accordingly, when the heat receiving part 32K is pressed against the developing device 19K, the engaging pin 140K can be prevented from separating from the developing device 19K due to reaction from the developing device 19K. As a result, the heat receiving part 32K can be pressed against the developing device 19K at a predetermined pressing force, so that the heat receiving part 32K can reliably contact the developing device 19K.

The guide part 423*a*K of the engaging hole 423K is tilted relative to the direction of attachment/detachment of the developing device 19K. Accordingly, the heat receiving part 32K can contact or separate from the developing device 19K by moving the retainer 41K in the direction of attachment/detachment of the developing device 19K. Further, the locking part 423*b*K of the engaging hole 423K is parallel to the direction of attachment/detachment of the developing device 19K so that the retainer 41K can be reliably locked at a predetermined position. As a result, the heat receiving part 32K can be pressed against the developing device 19K at a predetermined pressing force, so that the heat receiving part 32K can reliably contact the developing device 19K.

The coil spring 142K serving as the pressing means includes an elastic member so that a pressing force can be easily changed depending on a type of the elastic member.

The coil spring 142K is provided at multiple positions in the heat receiving part 32K in the longitudinal direction of the heat receiving part 32K, so that the heat receiving part 32K can be evenly pressed in the longitudinal direction of the developing device 19K. Accordingly, the developing device 19K can be evenly cooled in the longitudinal direction thereof.

The coil spring 142K is compressed between the bottom portion 32*e*K provided on the surface opposite the contact surface of the heat receiving part 32K and the opposing part 41*a*K of the retainer 41K, and the bottom portion 32*e*K is recessed toward the developing device 19K. Accordingly, the distance between the opposing part 41*a*K of the retainer 41K and the bottom portion 32*e*K is caused to be longer than the distance between the opposing part 41*a*K and the surface opposite the contact surface of the heat receiving part 32K. As a result, variation in the pressing force of the coil spring 142K due to a change in a length of the coil spring 142K can be reduced. Further, the distance between the opposing part 41*a*K and the surface opposite the contact surface of the heat receiving part 32K can be reduced, thereby downsizing the contact/separation mechanism 40K.

The contact/separation mechanism 40K is movably supported to the image forming apparatus 100 in a direction perpendicular to the direction of attachment/detachment of the developing device 19K. Accordingly, when the developing device 19K is attached askew to the image forming apparatus 100, the contact/separation mechanism 40K is moved such that the first and second engaged parts 191K and 192K do not get stuck to developing device 19K. As a result, even when the developing device 19K is attached askew to the image forming apparatus 100, the developing device 19K is smoothly inserted into the image forming apparatus 100.

A shield is provided to shield infrared light directed to the heat receiving part 32K from the components other than the developing device 19K, thereby preventing the heat receiving part 32K from being thermally affected by the components other than the developing device 19K. As a result, an increase in a temperature of the heat receiving part 32K can be prevented, thereby efficiently cooling the developing device 19K.

The retainer 41K to hold the heat receiving part 32K is used as the shield described above to reliably shield the infrared light directed to the heat receiving part 32K.

The components contacting the heat receiving part 32K of the contact/separation mechanism 40K such as the coil spring 142K and the shoulder screw 141K are formed of a material having a heat conductivity lower than that of the material used in the heat receiving part 32K. As a result, transmission of heat from those components to the heat receiving part 32K can be prevented, thereby preventing an increase in a temperature of the heat receiving part 32K.

The heat receiving part 32K is pressed against the bottom surface of the developing device 19K to cool a portion of the developing device 19K of which temperature increases the most. As a result, the developing device 19K can be efficiently cooled.

The coil spring 142K presses the contact/separation mechanism 40K upward in a vertical direction. Therefore, when contacting the first and second engaging parts 161K and 162K of the contact/separation mechanism 40K during attachment of the developing device 19K to the image forming apparatus 100, the coil spring 142K is elastically deformed to prevent the first and second engaging parts 161K and 162K from getting stuck. Accordingly, the first and second engaging parts 161K and 162K are prevented from getting stuck to the developing device 19K, so that the developing device 19K can be smoothly attached to the image forming apparatus 100 even when the developing device 19K is inserted askew into the image forming apparatus 100.

The force to press the contact/separation mechanism 40K upward in the vertical direction is weaker than the pressing force of the coil spring 142K. Accordingly, when the heat receiving part 32K is pressed against the developing device 19K, the contact/separation mechanism 40K is moved downward by reaction from the developing device 19K, so that the first and second engaging parts 161K and 162K can reliably contact the developing device 19K. As a result, the pressing force of the heat receiving part 32K applied to the developing device 19K can be reliably received by the first and second engaging parts 161K and 162K.

The coil spring 142K is used for pressing the contact/separation mechanism upward in the vertical direction. Accordingly, the force for pressing the contact/separation mechanism upward can be easily changed depending on a type of the coil spring 142K.

The image forming units 11Y, 11M, 11C, and 11K respectively including the photoconductors 18Y, 18M, 18C, and 18K and the developing device 19Y, 19M, 19C, and 19K are arranged in parallel to one another in the image forming apparatus 100, and the heat receiving part 32 is pressed against the surfaces of the multiple developing devices 19Y, 19M, 19C, and 19K. Therefore, a number of the heat receiving part can be reduced compared to the case in which the single heat receiving part is used for cooling the single developing device. Accordingly, a configuration of the liquid cooling device 30 can be simplified. Further, when the multiple developing devices 19Y, 19M, 19C, and 19K are replaced with new ones, the heat receiving part 32 can be separated from the multiple developing devices 19Y, 19M, 19C, and 19K with a single operation, thereby simplifying the operation.

The heat receiving part 32K may be pressed against both the bottom and lateral surfaces of the developing device 19K. As a result, the developing device 19K can be more efficiently cooled.

The position of the developing device 19K is determined relative to the photoconductor 18K, and the developing device 19K is detachably attachable to the image forming apparatus 100 integrally with the photoconductor 18K. As a result, variation in the developing gap can be prevented compared to the configuration in which the developing device 19K is detachably attachable solely to the image forming apparatus 100.

The heat conductive sheet 130K formed of a high efficient heat conductive material having a rigidity lower than the material used in the heat receiving part 32K is attached to the contact surface of the heat receiving part 32K contacting the developing device 19K. When the heat receiving part 32K is pressed against the developing device 19K, the heat conductive sheet 130K is deformed to reduce profile irregularity between the developing device 19K and the heat receiving part 32K. As a result, an airspace formed between the developing device 19K and the heat receiving part 32K can be prevented, thereby efficiently transmitting the heat from the developing device 19K to the heat receiving part 32K.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. An image forming apparatus, comprising:

a target part to be cooled detachably attachable to the image forming apparatus;

a cooling device including a heat receiving part provided to contact the target part to be cooled to receive heat from the target part to be cooled with a cooling medium provided within the heat receiving part; and a contact/separation mechanism to cause the heat receiving part to contact and separate from the target part to be cooled, the contact/separation mechanism including a pressing unit to press the heat receiving part against the target part to be cooled, wherein, when the heat receiving part is pressed against the target part to be cooled, the contact/separation mechanism engages with the target part to be cooled such that a reaction of a pressing force of the heat receiving part applied to the pressing unit is directed onto a predetermined portion of the target part to be cooled.

2. The image forming apparatus according to claim 1, wherein:

the contact/separation mechanism further comprises a reception unit to receive the reaction of the pressing force, the reception unit including an engaging part engaging with an engaged part provided to the target part to be cooled, and the engaging part engages with the engaged part when the reception unit receives the reaction of the pressing force to contact the contact/separation mechanism to the target part to be cooled.

3. The image forming apparatus according to claim 2, wherein the reception unit further comprises:

a retainer to hold the heat receiving part via the pressing unit; and a supporter including the engaging part to contactably and separably support the retainer to the target part to be cooled.

4. The image forming apparatus according to claim 3, wherein:

the retainer includes an engaging pin, and the supporter further includes an engaging hole engaging with the engaging pin to guide the engaging pin in a direction in which the heat receiving part moves to contact and separate from the target part to be cooled.

5. The image forming apparatus according to claim 4, wherein the engaging pin is provided at a center of the retainer in a direction of attachment/detachment of the target part to be cooled.

6. The image forming apparatus according to claim 5, wherein:

the supporter further comprises a back face facing a surface of an opposing part of the retainer provided opposite a heat receiving part-side surface of the opposing part, the opposing part facing a surface of the heat receiving part provided opposite a contact surface of the heat receiving part to contact the target part to be cooled; and a spacer formed of a material having a heat conductivity lower than a heat conductivity of the heat receiving part is provided at one of both ends on the back face of the supporter in the direction of attachment/detachment of the target part to be cooled and both ends on the surface of the opposing part of the retainer provided opposite the heat receiving part-side surface of the opposing part in the direction of attachment/detachment of the target part to be cooled.

7. The image forming apparatus according to claim 4, wherein the engaging pin is provided in a back of a center of the retainer in a direction of attachment/detachment of the target part to be cooled.

8. The image forming apparatus according to claim 7, wherein a protective layer to protect a contact surface is provided at least in a back of a center of the contact surface in the direction of attachment/detachment of the target part to be cooled, and in a back of a center of a surface of the target part to be cooled facing the heat receiving part in the direction of attachment/detachment of the target part to be cooled.

9. The image forming apparatus according to claim 4, wherein the engaging hole comprises:

a guide part to guide the engaging pin in the direction in which the heat receiving part moves to contact and separate from the target part to be cooled; and a locking part to lock the engaging pin when the heat receiving part is pressed against the target part to be cooled.

10. The image forming apparatus according to claim 9, wherein:

the guide part is angled relative to a direction of attachment/detachment of the target part to be cooled; and the locking part extends parallel to the direction of attachment/detachment of the target part to be cooled.

11. The image forming apparatus according to claim 1, wherein the contact/separation mechanism is movably supported to the image forming apparatus in a direction perpendicular to a direction of attachment/detachment of the target part to be cooled.

12. The image forming apparatus according to claim 1, wherein the pressing unit comprises multiple elastic members provided at multiple positions on the heat receiving part in a longitudinal direction of the heat receiving part.

13. The image forming apparatus according to claim 12, wherein an elastic member contact portion contacted by edges of the multiple elastic members is recessed toward the target part to be cooled from a surface of the heat receiving part provided opposite a contact surface thereof.

14. The image forming apparatus according to claim 1, wherein components contacting the heat receiving part are formed of a material having a heat conductivity lower than a heat conductivity of the heat receiving part.

15. The image forming apparatus according to claim 1, wherein the heat receiving part is pressed against a bottom surface of the target part to be cooled.

16. The image forming apparatus according to claim 15, further comprising a biasing unit to bias the contact/separation mechanism upward in a vertical direction.

17. The image forming apparatus according to claim 16, wherein a force of the biasing unit is weaker than a force of the pressing unit.

18. The image forming apparatus according to claim 1, wherein the heat receiving part is pressed against bottom and lateral surfaces of the target part to be cooled.

19. The image forming apparatus according to claim 1, further comprising a contact sheet including a high-efficient heat conductive material having a rigidity lower than a rigidity of the heat receiving part is provided on one a contact surface of the heat receiving part and a surface of the target part to be cooled that contacts the contact surface of the heat receiving part.

20. An image forming apparatus, comprising:

a latent image bearing member;

a developing device detachably attachable to the image forming apparatus, the developing device including a developer bearing member to convey a developer to a position opposite the latent image bearing member;

a positioning member to determine a position of the developing device relative to the latent image bearing member;

a cooling device including a heat receiving part provided to contact a surface of the developing device to receive heat from the developing device with a cooling medium provided within the heat receiving part; and a contact/separation mechanism to cause the heat receiving part to contact and separate from the developing device, the contact/separation mechanism including a pressing unit to press the heat receiving part against the surface of the developing device, wherein, when the heat receiving part is pressed against the surface of the developing device, the contact/separation mechanism engages with the developing device such that a reaction of a pressing force of the heat receiving part applied to the pressing unit is directed onto a predetermined portion of the developing device.

* * * * *